US010139146B2

(12) United States Patent
Park

(10) Patent No.: US 10,139,146 B2
(45) Date of Patent: Nov. 27, 2018

(54) APPARATUS AND METHOD FOR DRIVING ICEMAKER OF REFRIGERATOR

(71) Applicant: SCD CO., LTD., Gyeonggi-do (KR)

(72) Inventor: Jin Sung Park, Gyeonggi-do (KR)

(73) Assignee: SCD CO., LTD., Yongin-si, Gyeonggi-do ( * ) Notice: Subject to any disclaimer, the term of this patent is extended or adjusted under 35 U.S.C. 154(b) by 954 days.

(21) Appl. No.: 14/399,214

(22) PCT Filed: May 10, 2013

(86) PCT No.: PCT/KR2013/004139

§ 371 (c)(1),
(2) Date: Nov. 6, 2014

(87) PCT Pub. No.: WO2013/169058

PCT Pub. Date: Nov. 14, 2013

(65) Prior Publication Data

US 2015/0082816 A1 Mar. 26, 2015

(30) Foreign Application Priority Data

May 10, 2012 (KR) ..... 10-2012-0049650
May 10, 2012 (KR) ..... 10-2012-0049651

(51) Int. Cl.

*F25C 5/16* (2006.01)
*F25C 1/04* (2018.01)
*F25C 5/00* (2018.01)

(52) U.S. Cl.

CPC ..... *F25C 5/16* (2013.01); *F25C 1/04* (2013.01); *F25C 5/00* (2013.01); *F25C 2400/10* (2013.01); *F25C 2700/02* (2013.01)

(58) Field of Classification Search

CPC ..... F25C 5/16; F25C 1/04; F25C 2700/02; F25C 2400/10; F25C 5/00

(Continued)

(56) References Cited

U.S. PATENT DOCUMENTS 7,134,292 B2 11/2006 Oh
7,748,231 B2 7/2010 Chung (Continued)

FOREIGN PATENT DOCUMENTS

CN 1296160 A 5/2001
CN 1435618 A 8/2003

(Continued)

*Primary Examiner* — Frantz Jules
*Assistant Examiner* — Nelson Nieves
(74) *Attorney, Agent, or Firm* — Rabin & Berdo, P.C.

(57) ABSTRACT

An apparatus and a method for driving an icemaker for making ice cubes in a refrigerator. An ice-full state is sensed in such a way as to rotate an ejector and a cam gear in a reverse direction (opposite to an ice-ejecting direction), thereby preventing interference with the ice cubes present in the icemaker and thus enabling the ice-full state to be accurately sensed. A first torsion spring is mounted to an intermediate gear with a small rotation angle ratio to allow only a minimum amount of torque to be transferred to other components such as an ice-detecting lever, thereby increasing the durability of the components and providing a precise rotation force. The axial center of rotation of a second torsion spring is defined at a position that faces the other end (the revolving end) of the ice-detecting lever, to allow a minimum moment to be substantially constantly applied.

2 Claims, 20 Drawing Sheets

(58) Field of Classification Search
USPC ..... 62/137
See application file for complete search history.

(56) References Cited

U.S. PATENT DOCUMENTS

| | | | | |
|---|---|---|---|---|
| 8,528,350 | B2 | 9/2013 | Lee et al. | |
| 2005/0066670 | A1* | 3/2005 | Chung | F25C 1/04 62/137 |
| 2005/0072167 | A1 | 4/2005 | Oh | |
| 2005/0257536 | A1* | 11/2005 | Chung | F25C 5/187 62/135 |
| 2006/0131324 | A1* | 6/2006 | Noh | F25C 5/005 221/150 R |
| 2007/0103940 | A1* | 5/2007 | Chung | F25C 5/187 363/16 |
| 2007/0119516 | A1* | 5/2007 | Heger | B67D 1/16 141/86 |
| 2007/0220909 | A1* | 9/2007 | An | F25C 1/04 62/137 |
| 2008/0053140 | A1* | 3/2008 | Higashitani | F25C 1/04 62/351 |
| 2008/0053812 | A1* | 3/2008 | Higashitani | F25C 5/187 200/569 |
| 2008/0256962 | A1* | 10/2008 | Lee | F25C 5/187 62/137 |
| 2009/0151372 | A1* | 6/2009 | Lee | F25C 5/187 62/137 |
| 2009/0249817 | A1* | 10/2009 | Park | F25D 23/126 62/340 |
| 2009/0255282 | A1* | 10/2009 | Amonett | F25C 1/00 62/137 |
| 2010/0005818 | A1* | 1/2010 | Saito | F25C 1/04 62/137 |
| 2010/0031679 | A1* | 2/2010 | Park | F25C 1/04 62/129 |
| 2010/0175398 | A1* | 7/2010 | Lim | F25C 5/005 62/137 |
| 2010/0257888 | A1* | 10/2010 | Kang | F25C 1/04 62/340 |
| 2010/0313593 | A1* | 12/2010 | Lee | F25C 5/005 62/320 |
| 2010/0319385 | A1* | 12/2010 | Hashimoto | F16H 25/16 62/344 |
| 2011/0067429 | A1* | 3/2011 | Lee | F25C 5/005 62/344 |
| 2011/0265594 | A1* | 11/2011 | Ramirez, Jr. | F16H 57/039 74/416 |
| 2012/0023995 | A1* | 2/2012 | Lee | F25C 5/005 62/340 |
| 2012/0304680 | A1* | 12/2012 | Oh | F25C 5/005 62/320 |

FOREIGN PATENT DOCUMENTS

| | | | |
|---|---|---|---|
| CN | 1605823 | A | 4/2005 |
| CN | 1963346 | A | 5/2007 |
| CN | 101165441 | A | 4/2008 |
| EP | 2 343 216 | B1 | 7/2013 |
| JP | 10-311637 | A | 11/1998 |
| JP | 3827272 | B2 | 9/2006 |
| KR | 10-2005-0033754 | A | 4/2005 |
| KR | 10-0531290 | B1 | 11/2005 |
| KR | 10-2007-0050299 | A | 5/2007 |
| KR | 10-2007-0096552 | A | 10/2007 |
| KR | 10-2008-0035712 | A | 4/2008 |
| KR | 10-2011-0074893 | A | 7/2011 |
| KR | 10-1139899 | B1 | 4/2012 |

* cited by examiner $F_1 << F_2$
$r_1 = r_2$
$M_1 << M_2$ $F_1 << F_2$
$r_1 >> r_2$
$M_1 = M_2$

APPARATUS AND METHOD FOR DRIVING ICEMAKER OF REFRIGERATOR

TECHNICAL FIELD

The present invention relates to an apparatus and a method for driving an icemaker for making ice cubes in a refrigerator or the like, and more particularly, the present invention relates to an apparatus and a method for driving an icemaker for making ice cubes in a refrigerator or the like, in which an ice-full state is sensed in such a way as to rotate an ejector and a cam gear in a reverse direction (opposite to an ice-ejecting direction), thereby preventing interference with the ice cubes present in the icemaker and thus enabling the ice-full state to be accurately sensed.

Also, the present invention relates to an apparatus and a method for driving an icemaker for making ice cubes in a refrigerator or the like, in which a first torsion spring is mounted to an intermediate gear with a small rotation angle ratio to allow only a minimum amount of torque to be transferred to other components such as an ice-detecting lever, thereby increasing the durability of the components and providing a precise rotation force.

Further, the present invention relates to an apparatus and a method for driving an icemaker for making ice cubes in a refrigerator or the like, in which the axial center of rotation of a second torsion spring biasing the ice-detecting lever to elastically contact the cam surface of the cam gear is defined at a position that faces the other end (the revolving end) of the ice-detecting lever, to allow a minimum moment to be substantially constantly applied.

BACKGROUND ART

Conventional apparatuses for driving an icemaker of a refrigerator have been suggested as disclosed in the publications of, for example, the patent document 1 and the patent document 2.

As shown in FIGS. 1 to 2, a conventional apparatus for driving an icemaker of a refrigerator includes a driving motor 10; a cam assembly 30 which is disposed to be interlocked with an ejector E for ejecting the ice cubes made in an ice-making tray, to an ice bank; an ice-detecting arm 50 which detects the ice-full state of the ice cubes ejected to the ice bank as it is rotated by the cam assembly 30; a gear unit 40 which is interposed between the cam assembly 30 and the ice-detecting arm 50; an ice-full state sensing unit which senses the ice-full state of the ice bank by sensing the position of the cam assembly 30 when the cam assembly 30 is operated in the interlocked manner; and an ice-detecting arm sensing unit which senses whether or not the ice-detecting arm 50 has not returned to an initial position by being interfered with by the ice cubes present in the ice bank.

The cam assembly 30 includes a driving cam 31 which is transferred with the rotation force of the driving motor 10 using a motor or the like and is rotated along with the ejector E; and an ice-detecting lever 33 which is rotated by the driving cam 31 and of which rotation position is to be sensed by the ice-full state sensing unit.

The ice-detecting lever 33 is projectedly formed with a cam follower 34 which contacts a cam surface 31*a* of the driving cam 31. Also, a first extension 33*a* and a second extension 33*b* are formed on the ice-detecting lever 33 substantially opposite to the driving cam 31. Teeth 33*b*' are formed on the distal end of the second extension 33*b*.

The gear unit 40 is constructed by a first gear 41 which is meshed with the teeth 33*b*', a second gear 43 which is coupled to the same rotation shaft 42 as the first gear 41, and a third gear 45 which is meshed with the second gear 43.

A holder 47 is coupled to the third gear 45, and the ice-detecting arm 50 is held on the same rotation shaft 46 as the holder 47.

A torsion spring 49 is disposed between and coupled to the third gear 45 and the holder 47.

Therefore, even when an external force is applied to the ice-detecting arm 50 in a reverse direction, the reverse rotation thereof is substantially suppressed as the torsion spring 49 is elastically deformed, and thus, the forcible rotation of the third gear 45 connected to the ice-detecting lever 33 does not occur. Since the detailed description of the torsion spring 49 is concretely given in the patent document 1, it will be omitted herein.

In the conventional apparatus for driving an icemaker of a refrigerator, constructed as mentioned above, when ejecting ice cubes by using the ejector E, the ejector E scoops ice cubes while rotating in an ice-ejecting direction (the direction I), that is, an ice-discharging direction (hereinafter, referred to as a normal direction), and pushes the ice cubes to the left side when viewed on the drawing.

In order for the above-described ice-full state sensing unit to sense the ice-full state, the ice-detecting arm 50 is rotated while the ejector E is rotated in the normal direction as stated above. In this case, while the ejector E is rotated in the normal direction, the ejector E may be interfered with by the ice cubes present in the icemaker.

In other words, despite that the ice-full state should be sensed by the ice-detecting arm 50, in the case where the ejector E is interfered with by the ice cubes present in the icemaker as described above, a problem may be caused in that determination may be made to the ice-full state even though it is not the ice-full state and thus making of ice cubes may be stopped.

Meanwhile, the rotation angle ratio of the second gear 43 and the third gear 45 is 1:2. Accordingly, the displacement range of the torsion spring 49 is two times larger in the case where the torsion spring 49 is disposed between the third gear 45 and the holder 47 than in the case where the torsion spring 49 is disposed between the first gear 41 and the second gear 43.

Due to this fact, in the case where the torsion spring 49 is disposed between the third gear 45 and the holder 47, when compared to the case where the torsion spring 49 is disposed between the first gear 41 and the second gear 43, a maximum two times larger amount of torque is transferred to other components such as the ice-detecting lever 33. As a consequence, problems may be caused in that adverse influences are likely to be exerted on the components, for example, the durability of the components is likely to deteriorate or a precise rotation force is not likely to be provided.

A torsion spring 37 is disposed around the rotation center of the ice-detecting lever 33 to bias the cam follower 34 to elastically contact the cam surface 31*a*. The torsion spring 37 has a cylindrical coil part 37*a* which is installed by being fitted around the rotation center of the ice-detecting lever 33, a first arm 37*b* the distal end of which is supported by a first support pin 3 formed on a gear box 1 positioned adjacent to the first extension 33*a*, and a second arm 37*c* the distal end of which is supported by a second support pin 5 formed on the lower surface of the second extension 33*b*.

The torsion spring 37 having such a layout is encountered with a problem as shown in FIG. 19.

Namely, it may be seen that, if the second arm 37*c* is bent from the position shown by the dotted line (the state shown in FIG. 1) to the position shown by the dotted line (the state shown in FIG. 2), the reaction force applied to the ice-detecting lever 33 by the second arm 37*c* satisfies the relationship of F1<<F2.

Also, it may be seen that the arm length r1 of the reaction force F1 is approximately equal to the arm length r2 of the reaction force F2.

Accordingly, because the moment satisfies the relationship of M1(F1×r1)<<M2(F2×r2), the moment may be changed from a minimum value to a maximum value according to the direction of the force applied to the ice-detecting lever 33. As a consequence, problems may be caused in that adverse influences are likely to be exerted on the components interlocked with the ice-detecting lever 33, for example, the durability of the components is likely to deteriorate or a precise rotation force is not likely to be provided.

Meanwhile, since the icemaker and the driving apparatus described above belong to widely known technologies and are described in detail in prior art patent documents, specifically, such as Korean Patent No. 0531290, Korean Unexamined Patent Publication No. 2007-0096552 and Korean Unexamined Patent Publication No. 2008-0035712, detailed description and illustration thereof will be omitted.

DISCLOSURE

Technical Problem

The present invention has been made in an effort to solve the problems occurring in the related art, and an object of the present invention is to provide an apparatus and a method for driving an icemaker for making ice cubes in a refrigerator or the like, in which an ice-full state is sensed in such a way as to rotate an ejector in not a normal direction but a reverse direction, thereby preventing interference with the ice cubes present in the icemaker and thus enabling the ice-full state to be accurately sensed.

Another object of the present invention is to provide an apparatus and a method for driving an icemaker for making ice cubes in a refrigerator or the like, in which a first torsion spring is mounted to an intermediate gear with a small rotation angle ratio to allow only a minimum amount of torque to be transferred to other components such as an ice-detecting lever, thereby increasing the durability of the components and providing a precise rotation force.

Still another object of the present invention is to provide an apparatus and a method for driving an icemaker for making ice cubes in a refrigerator or the like, in which the axial center of rotation of a second torsion spring biasing the ice-detecting lever to elastically contact the cam surface of the cam gear is defined at a position that faces the other end (the revolving end) of the ice-detecting lever, to allow a minimum moment to be substantially constantly applied.

Technical Solution

In order to achieve the above objects, according to one aspect of the present invention, there may be provided a method for driving an icemaker of a refrigerator, the icemaker including an ice-detecting lever which is interlocked with a cam gear and revolves about a point, an ice-full state sensing unit which is interlocked with the ice-detecting lever and determines an ice-full state, and an ice-detecting arm which is interlocked with the cam gear and contacts ice cubes, wherein the ice-full state is determined as the cam gear, an ejector and the ice-detecting arm are rotated by a predetermined angle in a reverse direction (a direction opposite to an ice-ejecting direction) by a driving motor.

The ice-full state sensing unit may include an ice-full state sensing lever which is interlocked with the cam gear and revolves in upward and downward directions, an ice-full state sensing magnet which is mounted to the ice-full state sensing lever, and an ice-full state sensing sensor which is fixed to a side of a housing and is caused to face the ice-full state sensing magnet by revolving of the ice-full state sensing lever; and the ice-full state may be determined in such a manner that an ice-full state signal is generated in the case of the ice-full state as the ice-full state sensing lever is caused not to face the ice-full state sensing sensor and the ice-full state signal is not generated in the case of not the ice-full state as the ice-full state sensing lever is caused to face the ice-full state sensing sensor.

In the case where the ice-full state signal is generated as the cam gear is rotated in the reverse direction, the cam gear may be rotated in a normal direction (the ice-ejecting direction) and returns to an original position.

If the ice-full state signal is not generated even in the case where the cam gear is rotated by the predetermined angle in the reverse direction, the cam gear may be rotated in the normal direction (the ice-ejecting direction), eject ice cubes, and return to the original position.

A holding gear, which is interlocked with the ice-detecting arm, an ice-detecting arm sensing magnet, which is disposed on a side of the holding gear, and an ice-detecting arm sensing sensor, which is fixed to the side of the housing and is caused to face the ice-detecting arm sensing magnet by revolving of the holding gear, may be disposed; and, in the case where the ice-detecting arm sensing magnet does not face the ice-detecting arm sensing sensor even though the cam gear returns to the original position, it may be determined that the ice-detecting arm is not in an original position, and an operation may be stopped.

As a way of controlling the cam gear or the ejector to be maintained at a specified position, in the case where the cam gear is at the specified position, the ice-full state signal may be generated for a time longer than the case of the ice-full state as the ice-full state sensing lever is caused not to face the ice-full state sensing sensor; and, while the cam gear is rotated in the reverse direction, in the case where the ice-full state signal generated by the ice-full state sensing sensor is generated for a time longer than a predetermined time, the cam gear may be rotated oppositely by a preselected angle from an ending time of the ice-full state signal such that the cam gear or the ejector is maintained at the specified position.

In order to achieve the above objects, according to another aspect of the present invention, there may be provided an apparatus for driving an icemaker of a refrigerator, the icemaker including an ice-detecting lever which is interlocked with a cam gear and revolves about a point, an ice-full state sensing unit which is interlocked with the ice-detecting lever and determines an ice-full state, and an ice-detecting arm which is interlocked with the cam gear and contacts ice cubes, wherein the cam gear, which is interlocked with and is rotated by the driving motor, may include a cam gear body which is formed with teeth on a circumferential outer surface thereof, and an ice-full state sensing contour which projects in the shape of a ring on one side surface of the cam gear body and is brought into contact with one end of the ice-full state sensing lever of the ice-full state sensing unit, wherein the ice-full state sensing lever may include a sensing lever body which has the shape of a bar and is rotated about a point, and an engagement portion which projects from one end of the sensing lever body and contacts the ice-full state sensing contour, and wherein an ice-full state indicating groove may be defined on a circumferential portion of the ice-full state sensing contour, such that, in the case where the engagement portion is engaged into the ice-full state indicating groove, the ice-full state sensing lever is rotated by a predefined angle, causing the ice-full state sensing magnet not to face the ice-full state sensing sensor.

An origin indicating groove may be additionally defined to be indented on the circumferential portion of the ice-full state sensing contour in such a manner that a circumferential length of a bottom portion of the origin indicating groove is longer than a circumferential length of a bottom portion of the ice-full state indicating groove; and, if the engagement portion is engaged into the origin indicating groove, the ice-full state sensing lever may be rotated by a predefined angle to cause the ice-full state sensing magnet not to face the ice-full state sensing sensor.

A holding gear, which is interlocked with the cam gear at one portion thereof and is interlocked with the ice-detecting arm at an opposite portion thereof, and an ice-detecting arm sensing unit, which is disposed on the one portion of the holding gear, may be included; the ice-detecting arm sensing unit may include an ice-detecting arm sensing magnet which is disposed on the one portion of the holding gear, and an ice-detecting arm sensing sensor which is fixed to a side of a housing and is caused to face the ice-detecting arm sensing magnet by revolving of the holding gear; and, in the case where the ice-detecting arm does not return to the original position even though the cam gear returns to the original position, the ice-detecting arm sensing magnet may be caused not to face the ice-detecting arm sensing sensor.

The ice-detecting lever may include an ice-detecting lever body which has a plate shape and is disposed to be rotated about a point, and a groove which is defined to be indented on a side of the ice-detecting lever body and is brought into contact with an engagement bar interlocked with the cam gear; the groove may be defined such that a radius between one portion of the groove and a center of the cam gear is larger than a length of the engagement bar and a radius between the other portion of the groove and the center of the cam gear is smaller than the length of the engagement bar; and, in the case where the cam gear is rotated within a preset angle, the engagement bar may not contact the groove, and, in the case where the cam gear is rotated beyond the preset angle, the engagement bar may contact the groove and revolve the ice-detecting lever body in the upward direction.

A stopper may be projectedly formed on the one end of the ice-full state sensing lever, such that, when the ice-detecting lever body is rotated in the upward direction, the stopper is engaged with the ice-detecting lever body.

The driving motor which drives the cam gear may include a step motor.

A first transfer member, which is constructed by a plurality of gears, may be additionally included to be disposed between the driving motor and the cam gear so as to transfer power.

A control unit, which is connected to the driving motor, the ice-full state sensing unit or the ice-detecting arm sensing unit, may be additionally included.

An intermediate gear interposed between the ice-detecting lever which moves along a cam surface of the cam gear and the holding gear which holds the ice-detecting arm may be included; and the intermediate gear may include a first intermediate gear which is meshed with the ice-detecting lever, a second intermediate gear which has the same rotation shaft as the first intermediate gear, is meshed with the holding gear and has a smaller rotation angle than the holding gear, and a first torsion spring which is mounted between the first intermediate gear and the second intermediate gear.

A rotation angle ratio of the second intermediate gear and the holding gear may be set to approximately 1:2.

The first torsion spring may be constructed by a cylindrical coil part, and a first arm and a second arm which extend from one and opposite sides of the cylindrical coil part; first engagement projections and a first engagement groove, in which the first arm of the first torsion spring is engaged, may be formed on the first intermediate gear; second engagement projections, which interact with the first engagement projections, and a second engagement groove, in which the second arm of the first torsion spring is engaged, may be formed on the second intermediate gear, and a support shaft, around which the cylindrical coil part of the first torsion spring is fitted and supported, may be projectedly formed at a rotation center of the second intermediate gear; and a through hole, through which the support shaft passes by being inserted, may be defined at a rotation center of the first intermediate gear.

A driving block including a second torsion spring for elastically biasing the ice-detecting lever which moves along the cam surface of the cam gear and revolves the ice-detecting arm, against the cam surface, may be mounted to the housing which is constructed by a case and a cover, and a cylindrical coil part of the second torsion spring may be supported by the cover at a position that faces a revolving end of the ice-detecting lever.

The cylindrical coil part of the second torsion spring may be supported by a guide pin which is formed on the cover; a first arm which extends from one side of the cylindrical coil part may be supported by a first support pin which is formed on the other end portion of the ice-detecting lever; and a second arm which extends from an opposite side of the cylindrical coil part may be supported by a second support pin which is formed on the cover.

The features and advantages of the invention will become more apparent from the following detailed description in conjunction with the accompanying drawings.

The terms or words used in the description and claims are not to be interpreted by their typical or dictionary meanings, but their meanings and concepts should be interpreted in conformity with the technical idea of the invention, based on the principle that the inventor may properly define the concepts of the terms so as to explain the invention in the best manner.

Advantageous Effects

According to the embodiments of the present invention, advantages are provided in that, since interference between an ejector and the ice cubes present in an icemaker is prevented when sensing an ice-full state, it is possible to accurately sense the ice-full state.

Also, according to the embodiments of the present invention, advantages are provided in that, since a first torsion spring is mounted to an intermediate gear with a small rotation angle ratio, only a minimum amount of torque is transferred to other components such as an ice-detecting lever, whereby the durability of the components may be increased and a precise rotation force may be provided.

Further, according to the embodiments of the present invention, advantages are provided in that, since the axial center of rotation of a second torsion spring biasing the ice-detecting lever to elastically contact the cam surface of a cam gear is defined at a position that faces the other end (the revolving end) of the ice-detecting lever, a minimum moment is substantially constantly applied, whereby the durability of components may be increased and a precise rotation force may be provided.

MODE FOR INVENTION

Figure 1:
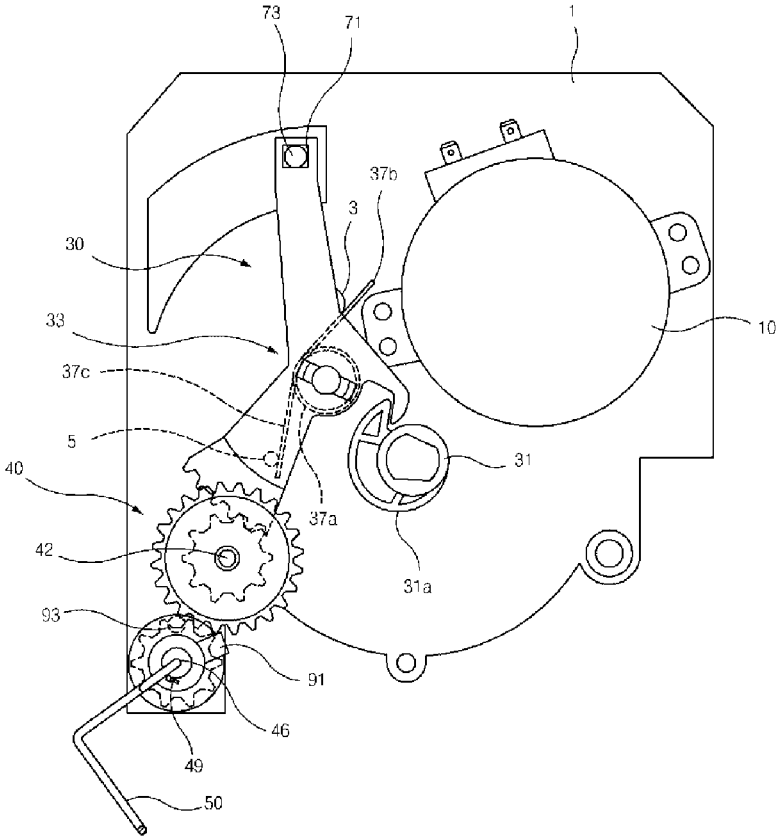
FIGS. 1 and 2 are side views illustrating a conventional apparatus for driving an icemaker of a refrigerator.
Figure 2:
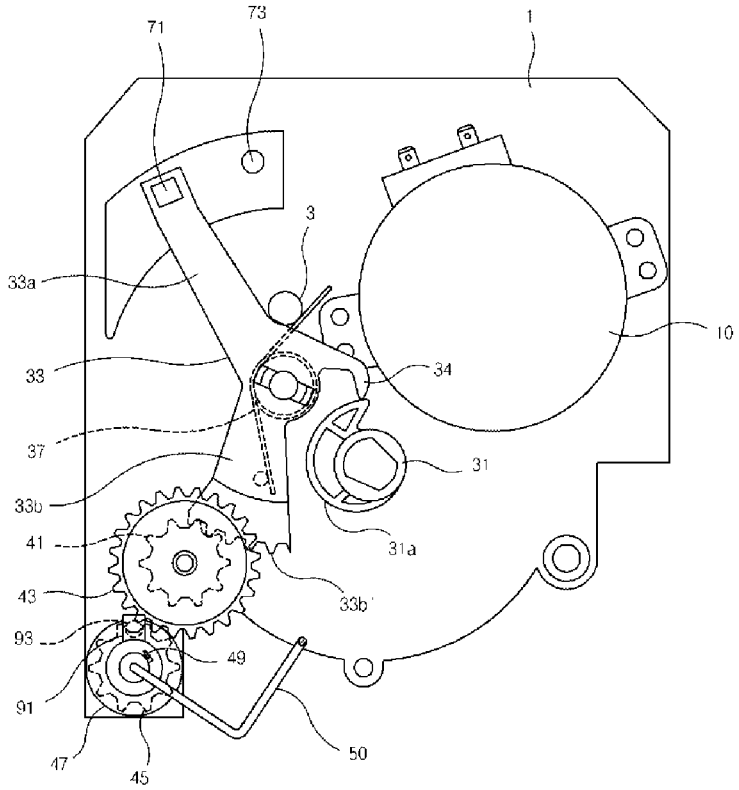

The objects, advantages and novel features of the invention will become more apparent from the following detailed description of exemplary embodiments when taken in conjunction with the accompanying drawings. In the following description, when adding reference numerals to the component elements of respective drawings, the same component elements will be designated by the same reference numerals although they are shown in different drawings. The terms such as "first", "second", "one portion", "the other portion", and so forth are to distinguish certain component elements from other component elements, and thus, the component elements are not limited by such terms. When it is considered that a specific description for the related known technology unnecessarily obscures the purpose of the invention, the detailed descriptions thereof will be omitted.

Hereafter, exemplary embodiments of the present invention will be described in detail with reference to the accompanying drawings.

Figure 3:
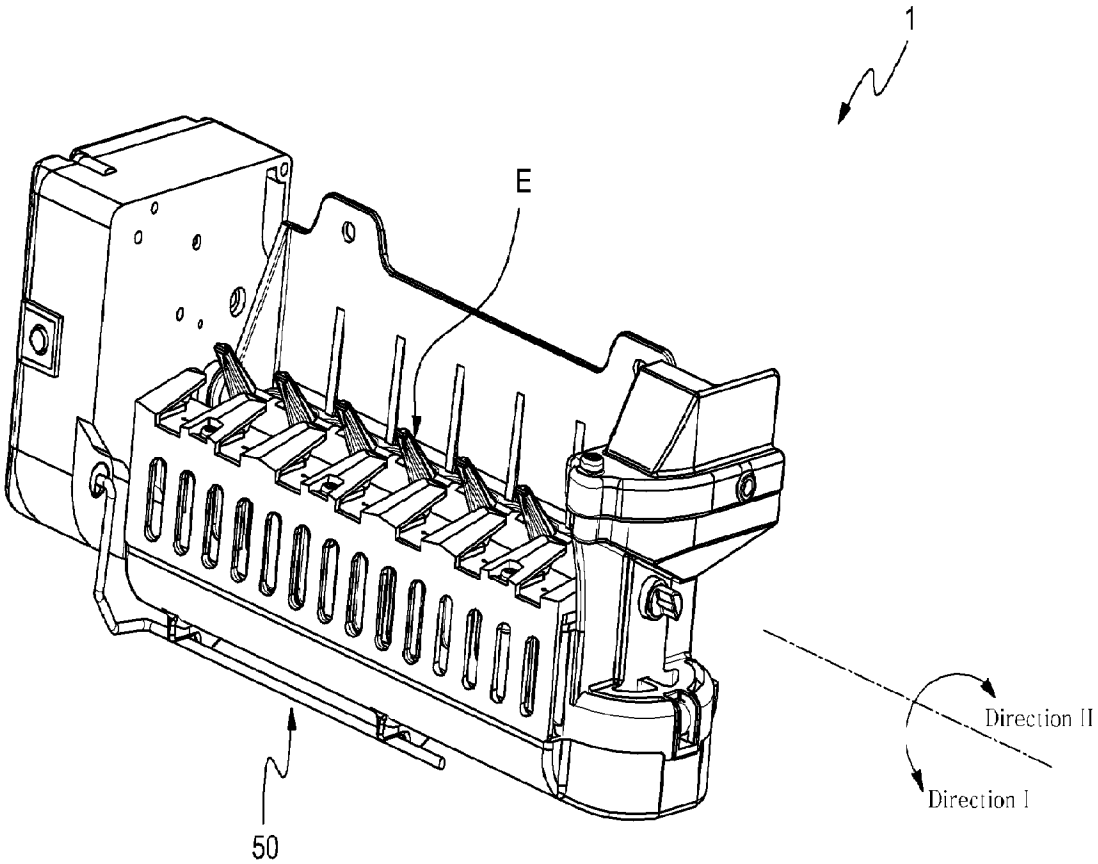
FIGS. 3 and 4 are an assembled perspective view and an exploded perspective view, respectively, illustrating an apparatus for driving an icemaker of a refrigerator in accordance with an embodiment of the present invention.
Figure 4:
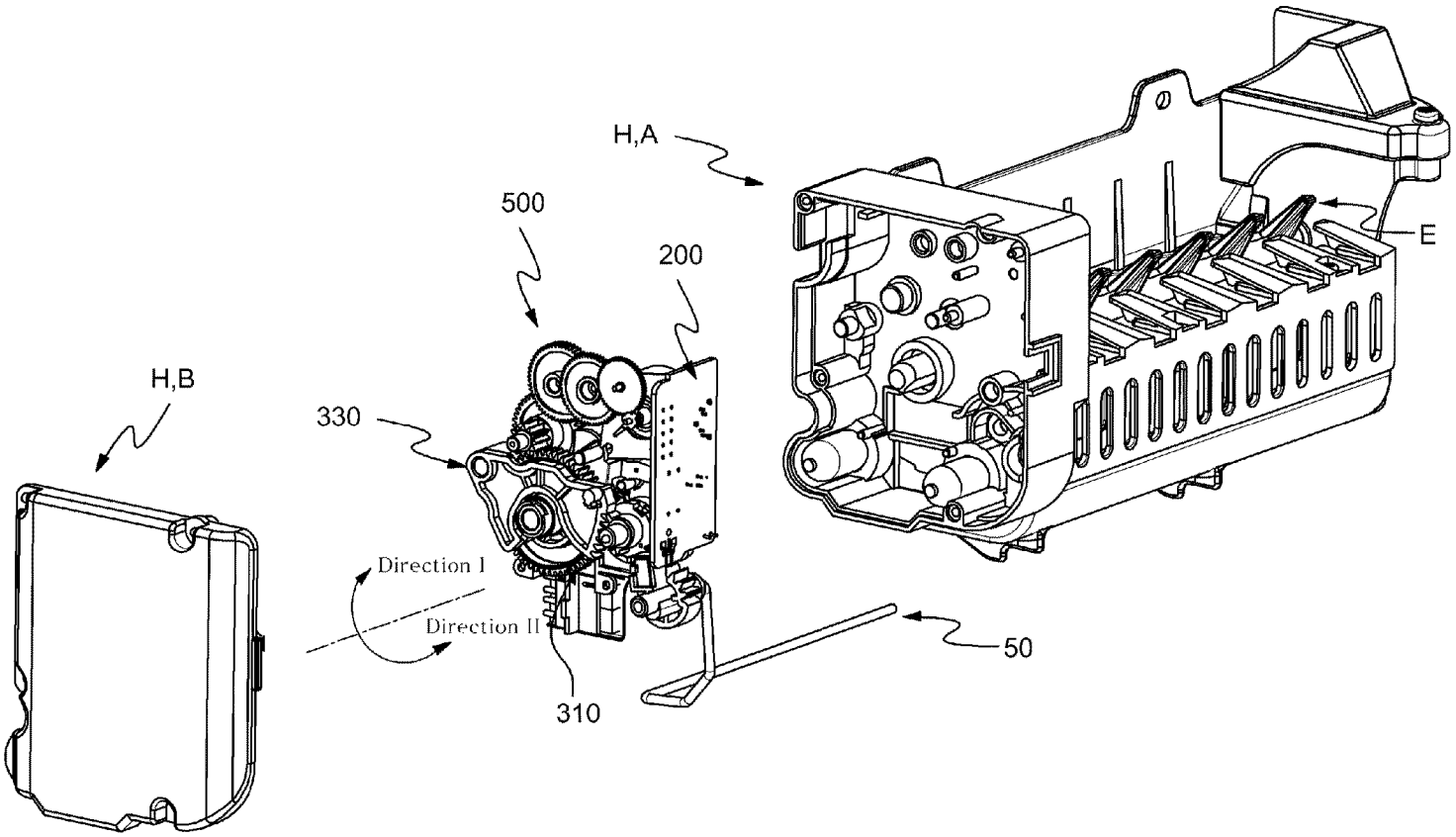
Figure 7:
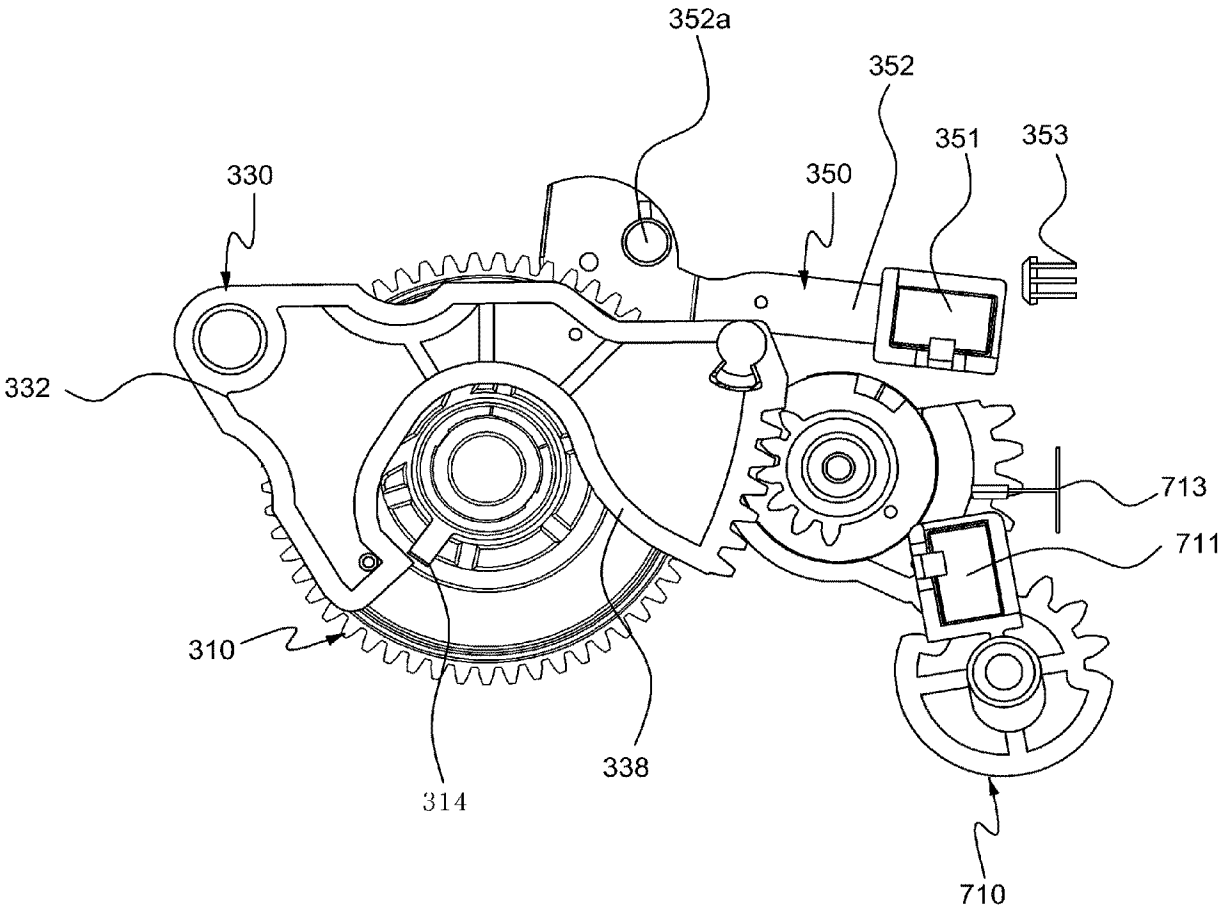
Figure 8:
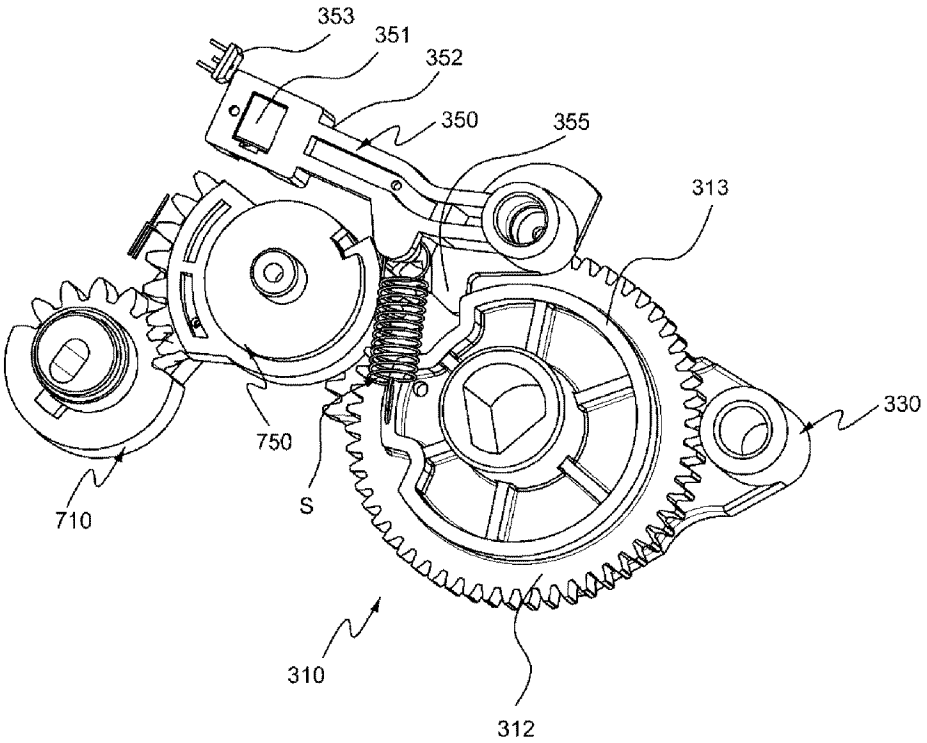
Figure 9:
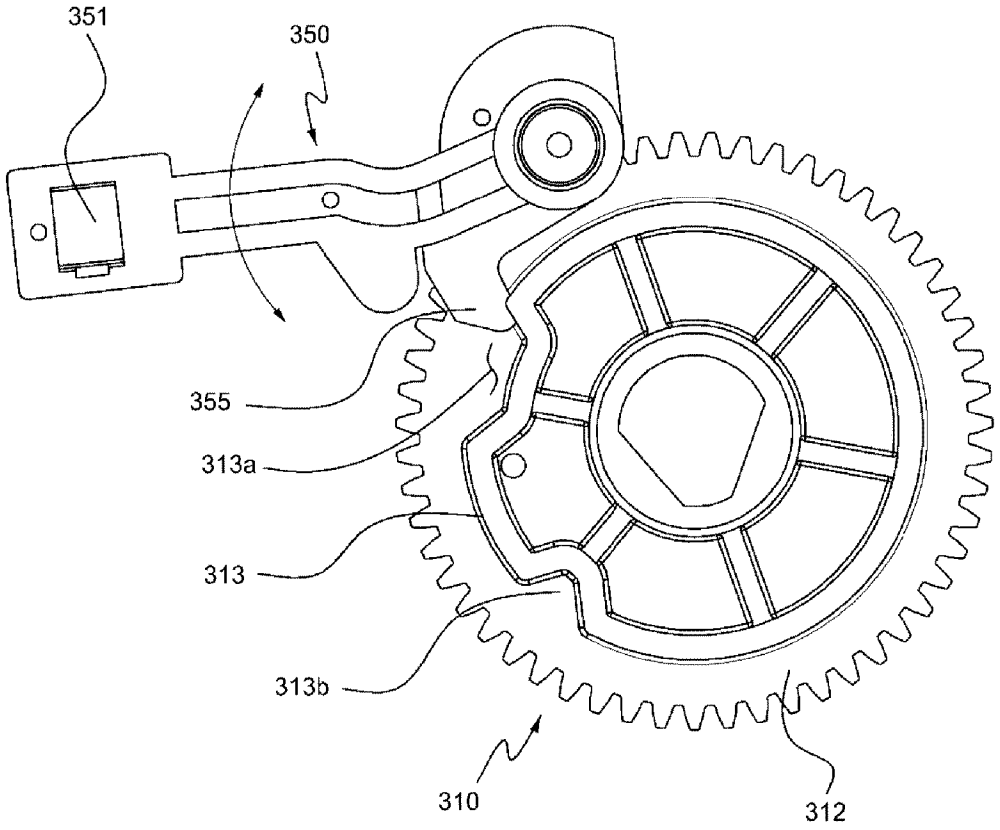
FIG. 9 is a side view illustrating only the ice-full state sensing unit and the cam gear in accordance with the embodiment of the present invention.
Figure 10:
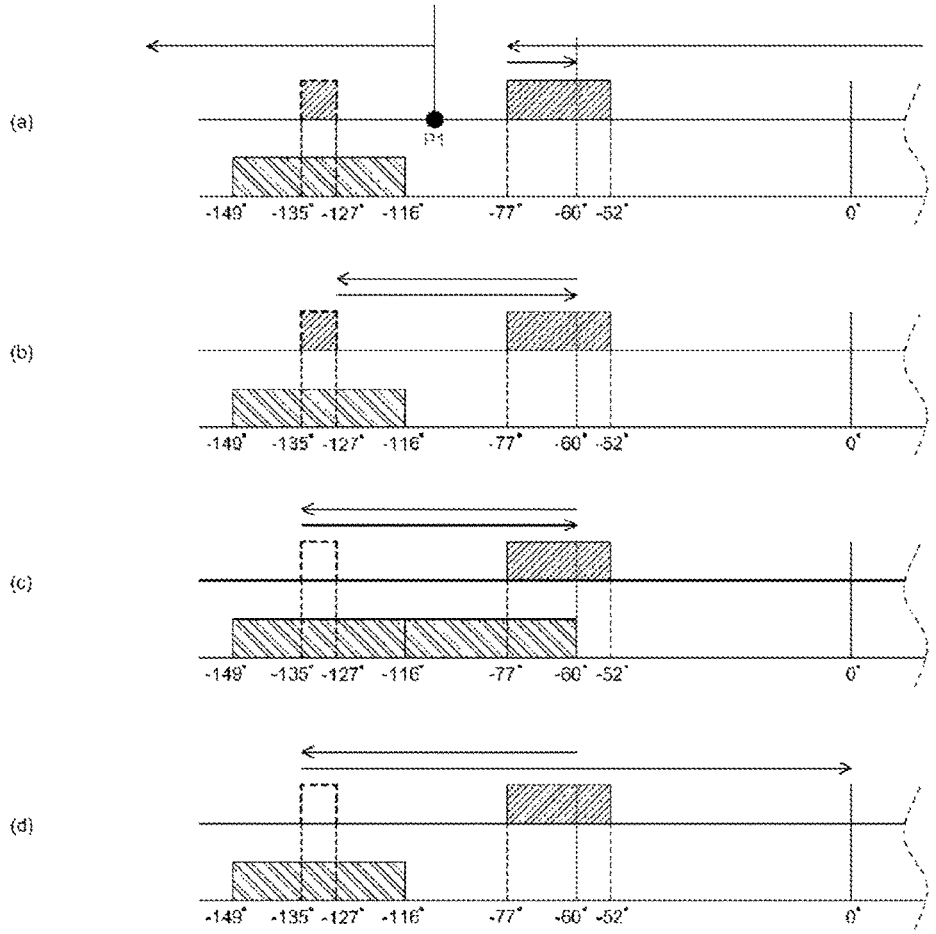
FIG. 10 is a conceptual diagram explaining a method for driving an icemaker of a refrigerator in accordance with an embodiment of the present invention.
Figure 11:
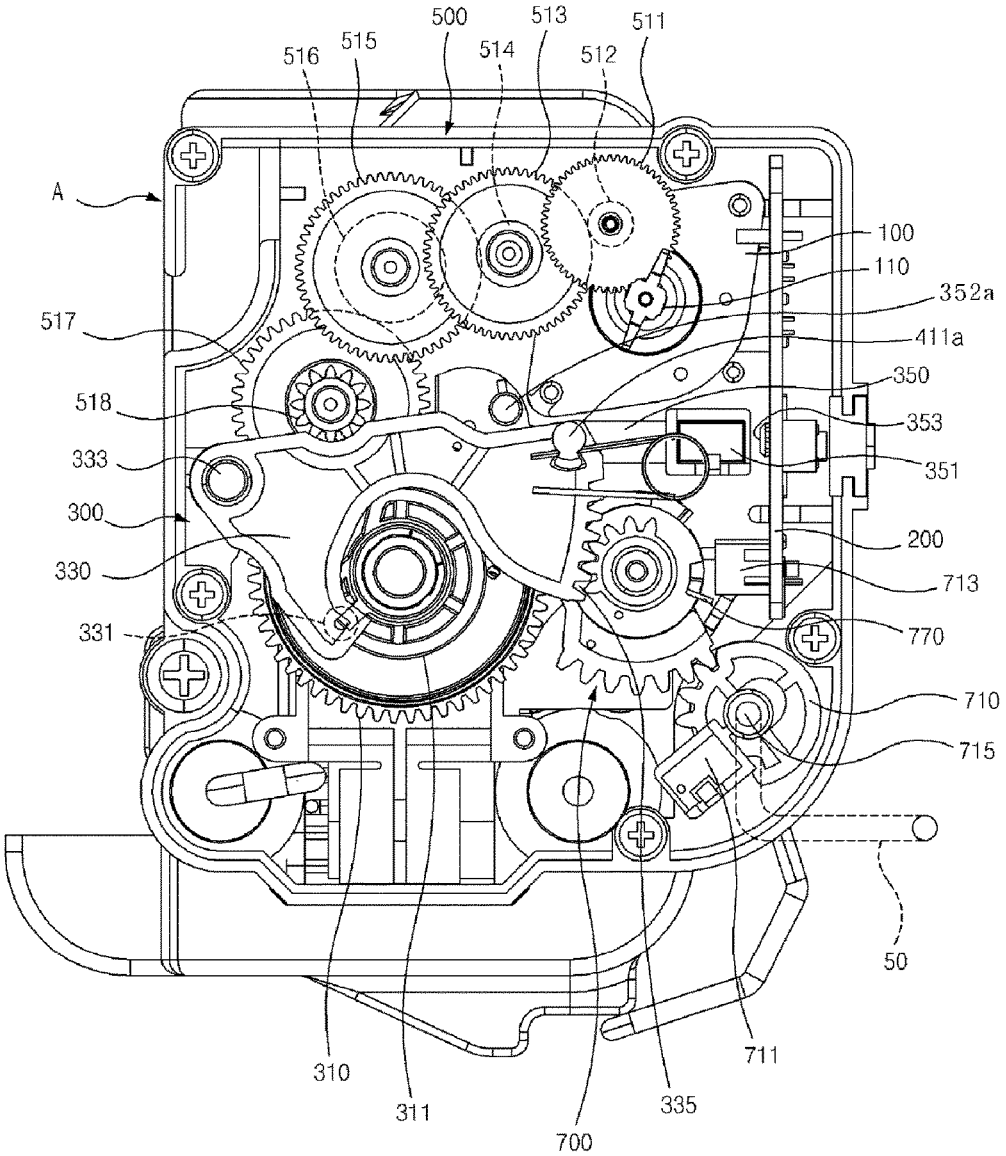
FIGS. 11 and 13 are side views showing operations of the apparatus for driving an icemaker of a refrigerator in accordance with the embodiment of the present invention.
Figure 12:
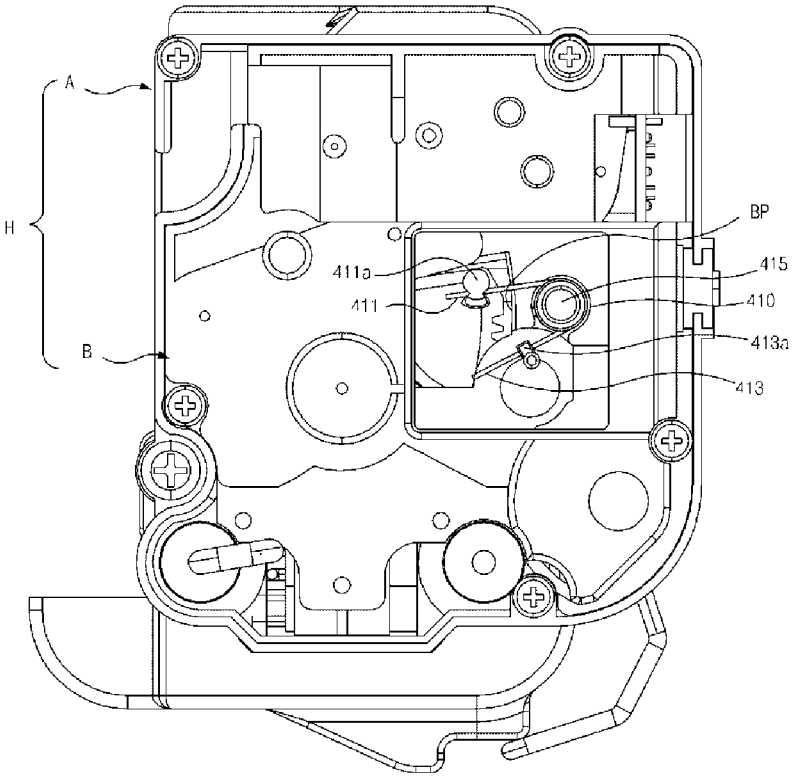
FIGS. 12 and 14 are side views illustrating the state in which a cover is mounted in FIGS. 11 and 13.
Figure 13:
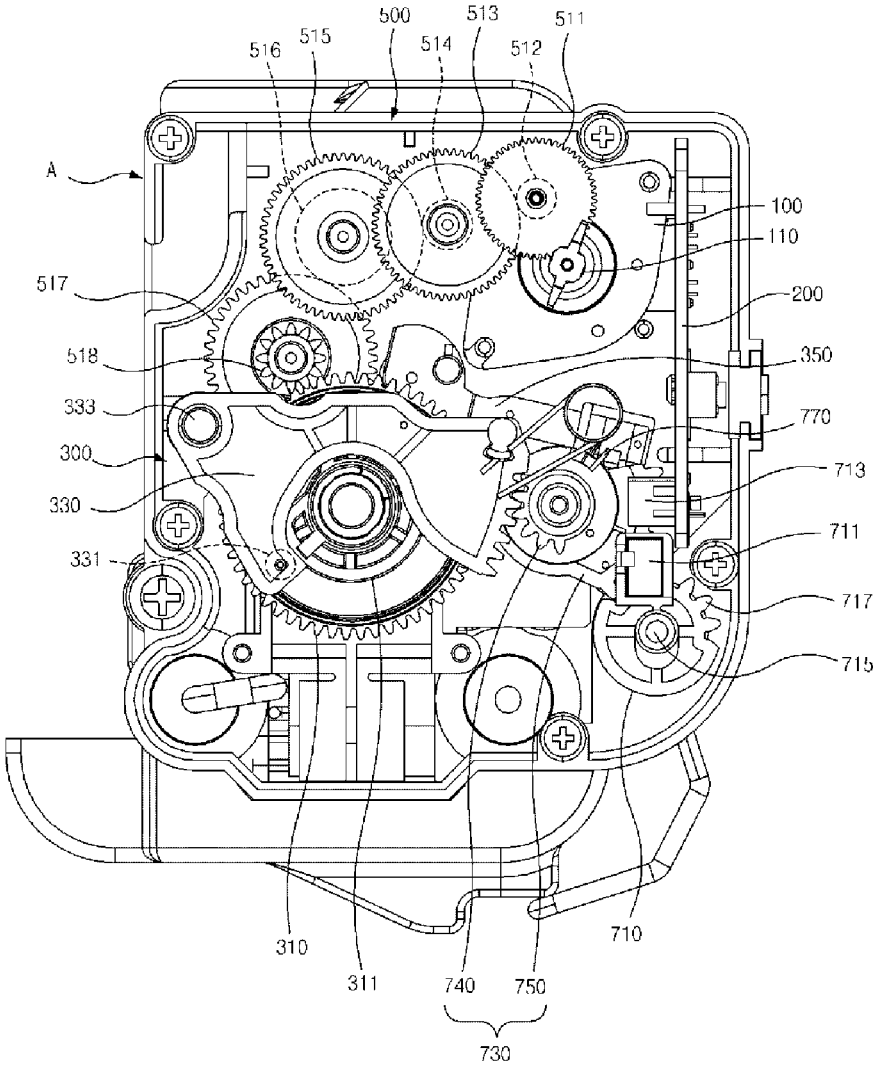
Figure 14:
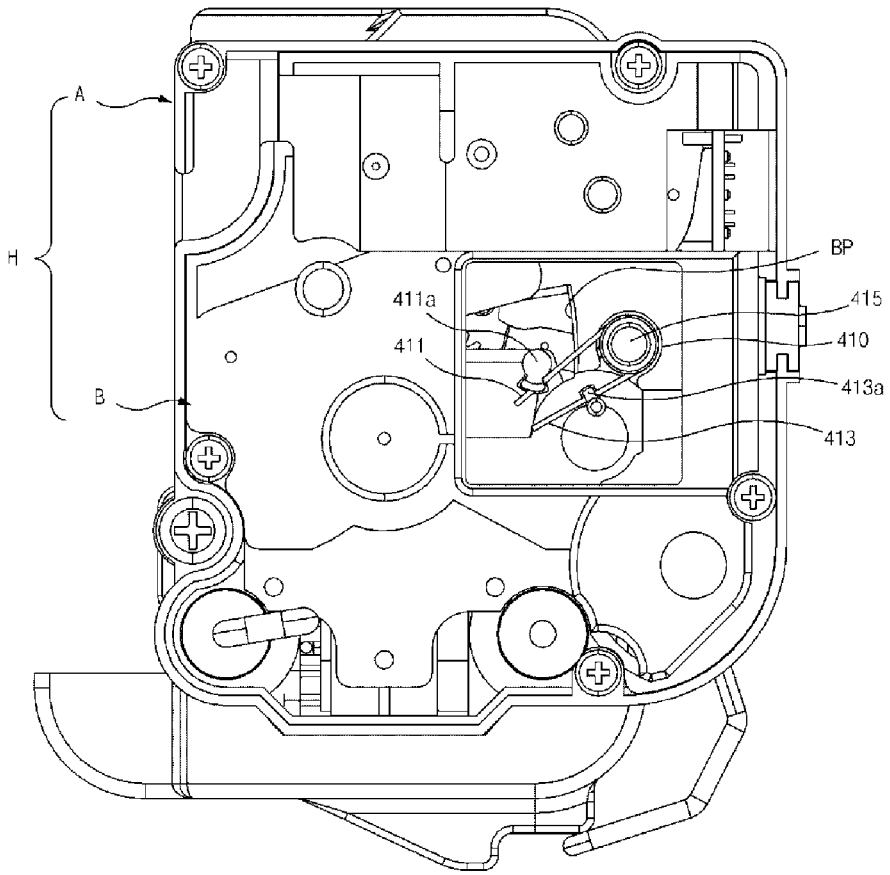
Figure 15:
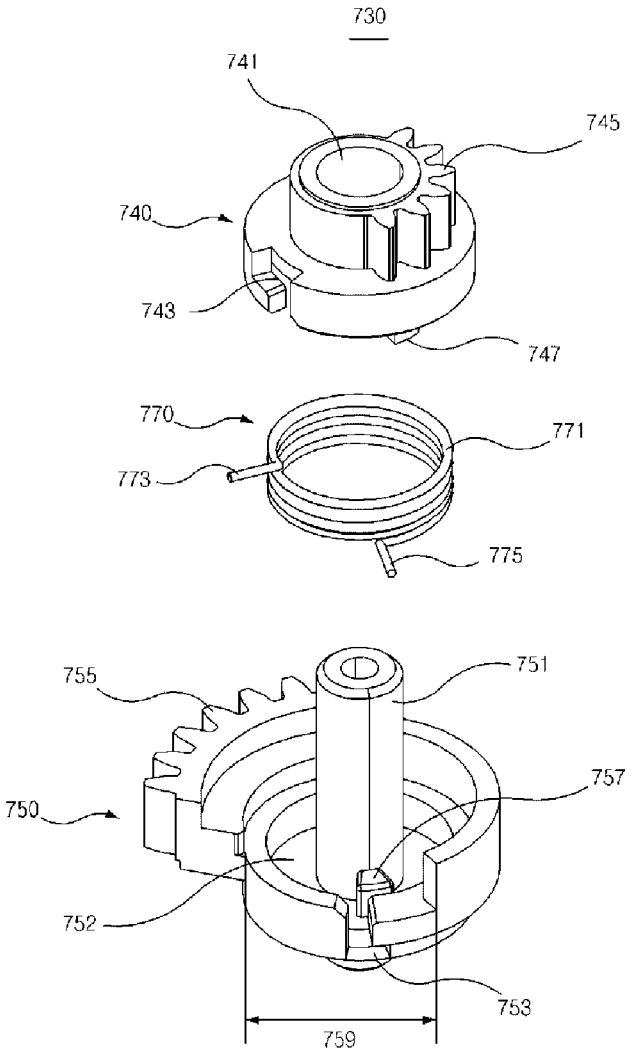
FIGS. 15 and 16 are exploded and assembled top perspective views illustrating intermediate gears.
Figure 16:
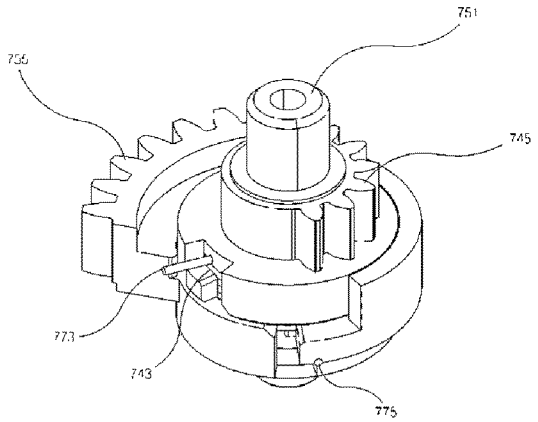
Figure 17:
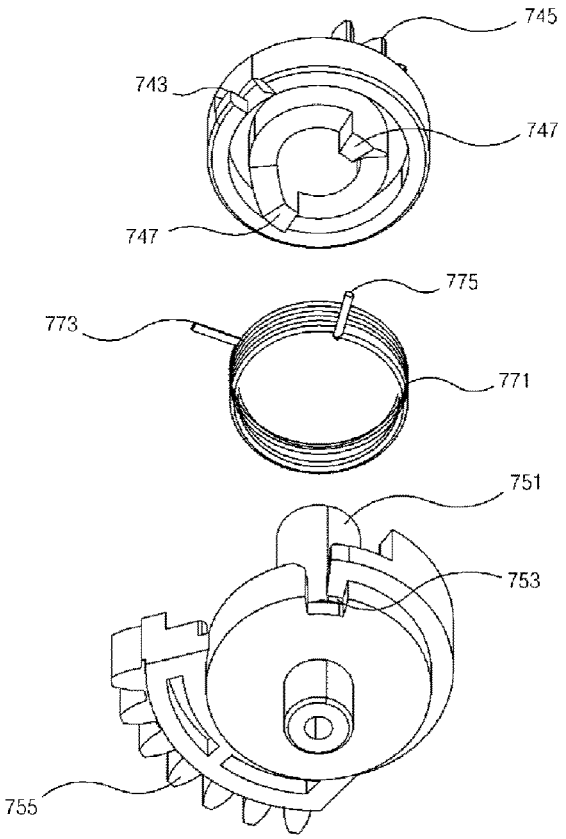
FIGS. 17 and 18 are exploded and assembled bottom perspective views illustrating the intermediate gears.
Figure 18:
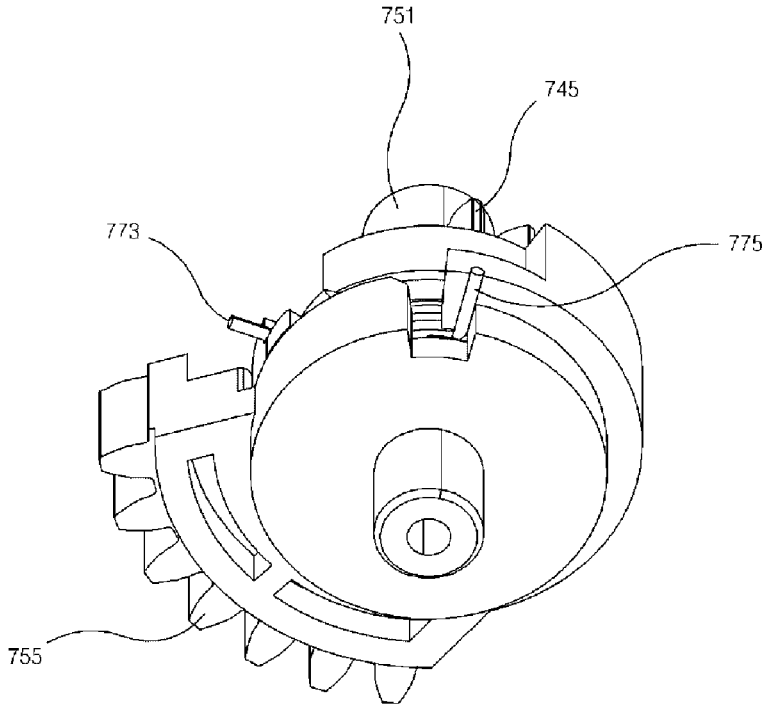
Figure 19:
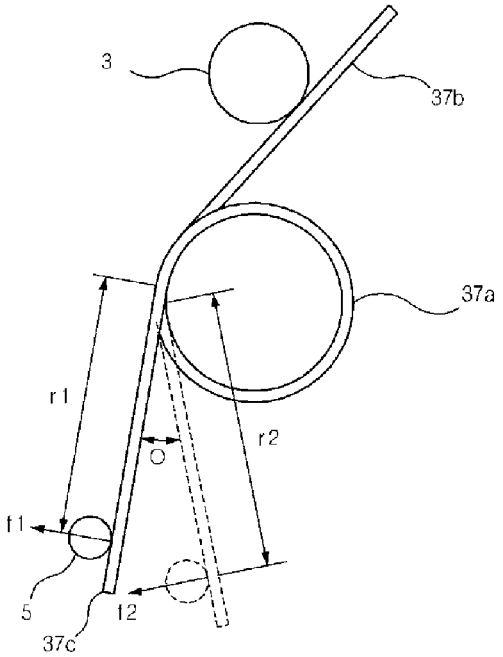
FIG. 19 is a conceptual diagram explaining the state in which a torsion spring acts in the conventional apparatus for driving an icemaker of a refrigerator.
Figure 20:
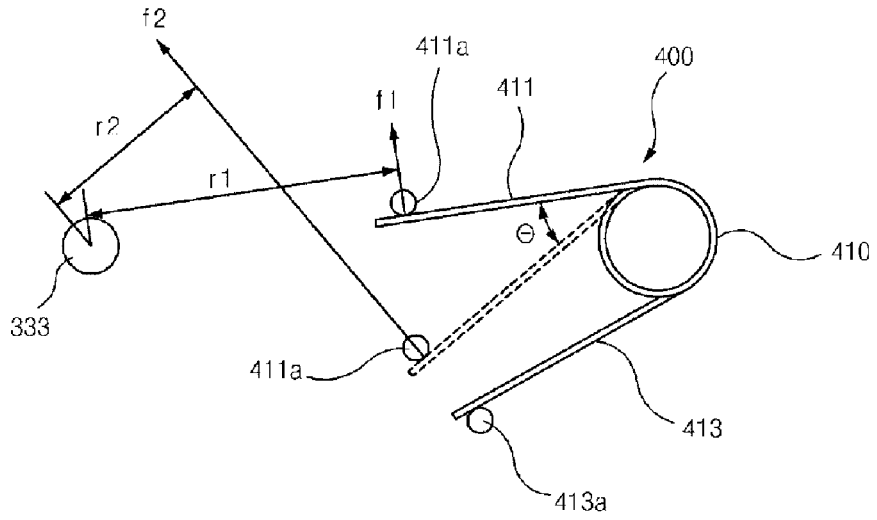
FIG. 20 is a conceptual diagram explaining the state in which a second torsion spring acts in the apparatus for driving an icemaker of a refrigerator in accordance with the embodiment of the present invention.
Figure 21:
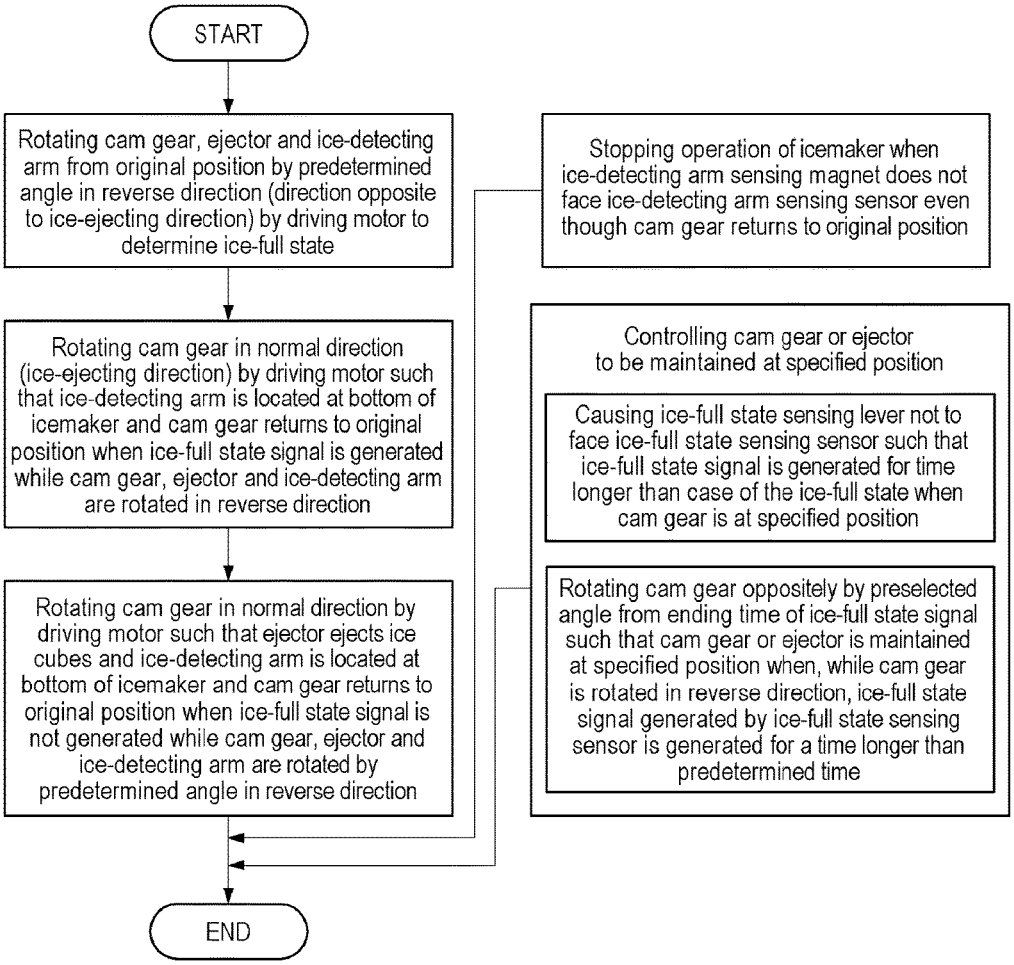
FIG. 21 is a flow chart diagram showing a method for driving an icemaker of a refrigerator according to an embodiment of the present invention.

As attached hereto, FIGS. 3 and 4 are an assembled perspective view and an exploded perspective view, respectively, illustrating an apparatus for driving an icemaker of a refrigerator in accordance with an embodiment of the present invention; FIGS. 5 to 8 are partial perspective views illustrating the front and rear surfaces of a cam gear, an ice-detecting lever, an ice-full state sensing unit and an ice-detecting arm sensing unit in accordance with the embodiment of the present invention; FIG. 9 is a side view illustrating only the ice-full state sensing unit and the cam gear in accordance with the embodiment of the present invention; FIG. 10 is a conceptual diagram explaining a method for driving an icemaker of a refrigerator in accordance with an embodiment of the present invention; FIGS. 11 and 13 are side views showing operations of the apparatus for driving an icemaker of a refrigerator in accordance with the embodiment of the present invention; FIGS. 12 and 14 are side views illustrating the state in which a cover is mounted in FIGS. 11 and 13; FIGS. 15 and 16 are exploded and assembled top perspective views illustrating intermediate gears; FIGS. 17 and 18 are exploded and assembled bottom perspective views illustrating the intermediate gears; FIG. 19 is a conceptual diagram explaining the state in which a torsion spring acts in the conventional apparatus for driving an icemaker of a refrigerator; and FIG. 20 is a conceptual diagram explaining the state in which a second torsion spring acts in the apparatus for driving an icemaker of a refrigerator in accordance with the embodiment of the present invention.

First, when defining terms to be used in the following description, a normal direction indicates a direction (the direction I) in which an ejector E rotates to eject ice cubes and an inverse direction indicates a direction (the direction II) opposite to the normal direction, as shown in FIGS. 3 and 4.

Since a housing H including a cover B and a case A as shown in FIG. 4 and the ejector E are the same as those of the conventional art, detailed description thereof will be omitted.

Figure 5:
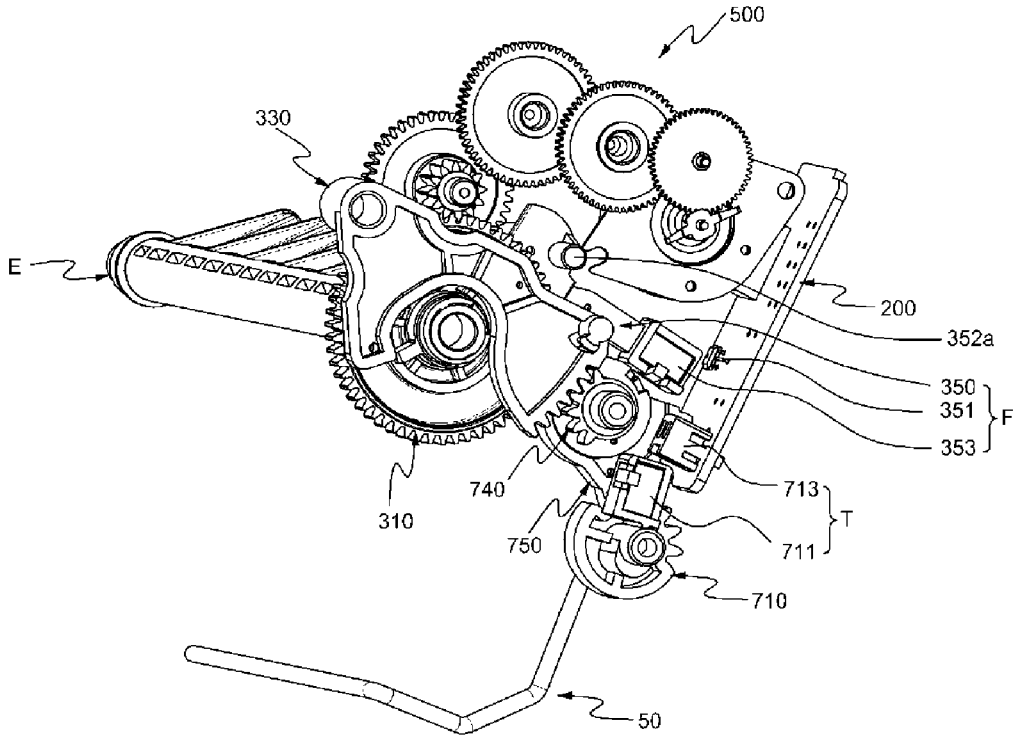
FIGS. 5 to 8 are partial perspective views illustrating the front and rear surfaces of a cam gear, an ice-detecting lever, an ice-full state sensing unit and an ice-detecting arm sensing unit in accordance with the embodiment of the present invention.
Figure 6:
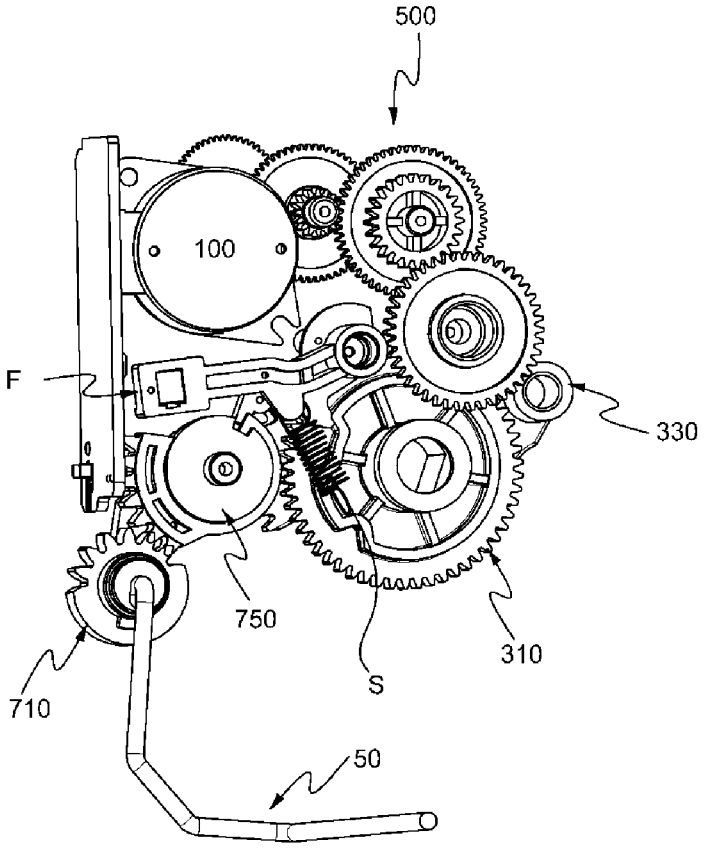

In accordance with an embodiment of the present invention, there is provided a method for driving an icemaker 1 including an ice-detecting lever 330 which is interlocked with a cam gear 310 and revolves about a point, an ice-full state sensing unit F (see FIG. 5) which is interlocked with the ice-detecting lever 330 and determines an ice-full state, and an ice-detecting arm 50 which is interlocked with the cam gear 310 and contacts ice cubes, wherein the ice-full state is determined as the cam gear 310, the ejector E and the ice-detecting arm 50 are rotated by a predetermined angle in the reverse direction (the direction II) by a driving motor 100 (see FIG. 6).

In the conventional art, as described above, the ice-full state is sensed as the ejector E is rotated in the normal direction (the direction I), that is, a direction in which the ejector E is introduced into the icemaker. In this case, since the ejector E is likely to be interfered with by the ice cubes present in the icemaker, a problem may be caused in that determination may be made as the ice-full state even though it is not the ice-full state and thus making of ice cubes may be stopped.

In the present invention, in order to cope with this problem, the ice-full state is sensed as the ejector E is rotated in the reverse direction (the direction II), that is, a direction opposite to the direction in which the ejector E is introduced into the icemaker. In this case, since the possibility of the ejector E to be interfered with by the ice cubes present in the icemaker is eliminated, accurate sensing of the ice-full state is possible.

As shown in FIGS. 5 and 6, the ice-full state sensing unit F may include an ice-full state sensing lever 350 which is interlocked with the cam gear 310 and revolves in upward and downward directions, an ice-full state sensing magnet 351 which is mounted to the ice-full state sensing lever 350, and an ice-full state sensing sensor 353 which is fixed to a side of the housing H (see FIG. 4) and may face the ice-full state sensing magnet 351 by the revolving of the ice-full state sensing lever 350.

Due to this fact, the ice-full state may be determined in such a manner that an ice-full state signal is generated in the case of the ice-full state as the ice-full state sensing lever 350 is caused not to face the ice-full state sensing sensor 353 and the ice-full state signal is not generated in the case of not the ice-full state as the ice-full state sensing lever 350 is caused to face the ice-full state sensing sensor 353, which will be described below with reference to FIG. 10.

That is to say, as shown in FIG. 10(*b*), in the case where the ice-full state signal is generated as the ice-full state sensing lever 350 does not face the ice-full state sensing sensor 353 while the cam gear 310 is rotated in the reverse direction, the cam gear 310 may then be rotated in the normal direction (the ice-ejecting direction), return to an original position and be maintained in a standby state.

In FIG. 10(*b*), the original position, that is, an origin is shown, by way of example, as the state of −60°, and reverse rotation is represented as being implemented by movement in the leftward direction on the drawing.

The state of −60° represents the state in which the ejector E is reversely rotated by 60° from a horizontal position.

As may be seen from the drawing, while the ejector E having been maintained in the standby state at the origin of −60° is rotated in the reverse direction (moved in the leftward direction on the drawing) by the rotation of the cam gear 310, if the ice-full state signal is generated at the point of −127°, the ejector E is then rotated in the normal direction (moved in the rightward direction on the drawing) and is stopped at the position of −60° as the origin. A construction for this will be described later.

Therefore, according to the embodiment of the present invention, because the ejector E is not introduced into the icemaker and is rotated outward when sensing the ice-full state, the ejector E is prevented from being interfered with by the ice cubes present in the icemaker as described above, whereby it is possible to eliminate the likelihood of the ice-full state signal to be erroneously generated.

If the ice-full state signal is not generated even in the case where the cam gear 310 is rotated by the predetermined angle in the reverse direction, the cam gear 310 is then rotated in the normal direction, ejects ice cubes, and returns to the original position.

In other words, as shown in FIG. 10(*d*), if the ice-full state signal is not generated even when the ejector E having been maintained in the standby state at the origin of −60° is rotated by the predetermined angle, for example, to the position of −135°, in the reverse direction (moved in the leftward direction on the drawing) by the rotation of the cam gear 310, it is determined that ice cubes are insufficient, and the ejector E is rotated in the normal direction to make one complete rotation, ejects ice cubes and is then stopped at the position of −60° as the origin. A construction for this will be described later.

In the meantime, while the ejector E is maintained in the standby state at a specified position, for example, the origin of −60° as described above, if a situation occurs in which, for example, the power of a refrigerator is off and the refrigerator stops to operate, it is necessary to control the ejector E to return to the origin.

To this end, in the case where the cam gear 310 which drives the ejector E is at the specified position, that is, the origin, the ice-full state signal is generated for a time longer than the case of the actual ice-full state, as the ice-full state sensing lever 350 is caused not to face the ice-full state sensing sensor 353.

While the cam gear 310 is rotated in the reverse direction, in the case where the ice-full state signal generated by the ice-full state sensing sensor 353 is generated for a time longer than a predetermined time, the cam gear 310 is rotated in the opposite normal direction by a preselected angle from the ending time of the ice-full state signal such that the cam gear 310 and the ejector E may be maintained at the specified position, that is, the origin.

Namely, as shown in FIG. 10(*a*), the ice-full state signal for the actual ice-full state is set to have the interval of 8° from −127° to −135°, and the ice-full state signal for finding the origin is set to have the interval of 25° from −52° to −77°.

By such a method, in the case where power supply is interrupted in the state in which the ejector E is at the position of −100° and is then restarted, if the ice-full state signal is generated between −127° and −135° as the cam gear 310 and the ejector E are rotated in the reverse direction (moved in the leftward direction on the drawing), since the ice-full state signal has been generated for an angle smaller than the interval of 25°, the ejector E is continuously rotated in the reverse direction by neglecting the ice-full state signal, to make one complete rotation.

Thereafter, if the ice-full state signal is generated when the ejector E reaches the position of −52° and is continuously generated to the position of −77°, the ice-full state signal is determined as the ice-full state signal for finding the specified position, that is, the origin.

In this case, the ejector E is rotated in the normal direction (moved in the rightward direction on the drawing) from the position where the generation of the ice-full state signal is ended, that is, from the position of −77°, by the preselected angle, that is, −17°, such that the ejector E is positioned at the origin.

If the ice-full state signal is not generated between −127° and −135° (the ice-full state has not occurred), the ejector E is continuously rotated in the reverse direction to make one complete rotation. Then, if the ice-full state signal is generated when the ejector E reaches the position of −52° and is continuously generated to the position of −77°, the ice-full state signal is determined as the ice-full state signal for finding the specified position, that is, the origin, as described above.

However, such a driving method may be used only in a particular situation, that is, only when power supply or the like is interrupted, and may not be used in a normal situation. That is to say, only in the case where a control unit recognizes the situation, an initial setting operation for finding the position of the origin may be performed as described above.

While the ice-detecting arm 50 is rotated, a phenomenon may occur in which the ice-detecting arm 50 is interfered with by ejected ice cubes and is not able to return to an original position.

In order to cope with this problem, there are disposed a holding gear 710 which is interlocked with the ice-detecting arm 50, an ice-detecting arm sensing magnet 711 which is disposed on a side of the holding gear 710, and an ice-detecting arm sensing sensor 713 which is fixed to the side of the housing H and may face the ice-detecting arm sensing magnet 711 by the revolving of the holding gear 710. Due to this fact, in the case where the ice-detecting arm sensing magnet 711 does not face the ice-detecting arm sensing sensor 713 even though the cam gear 310 has returned to the original position, it is determined that the ice-detecting arm 50 is not in the original position, and an operation may be stopped. A construction for this will be described later.

As shown in FIGS. 5 and 6, the apparatus for driving an icemaker in accordance with the embodiment of the present invention is an apparatus for driving an icemaker, including the ice-detecting lever 330 which is interlocked with the cam gear 310 and revolves about a point, the ice-full state sensing unit F which is interlocked with the ice-detecting lever 330 and determines the ice-full state, and the ice-detecting arm 50 which is interlocked with the cam gear 310 and contacts ice cubes.

The cam gear 310 is interlocked with and is rotated by the driving motor 100 which uses a motor or the like. As shown in FIGS. 7 and 8, the cam gear 310 includes a cam gear body 312 which is formed with teeth on the circumferential outer surface thereof, and an ice-full state sensing contour 313 which projects in the shape of a ring on one side surface of the cam gear body 312 and is brought into contact with one end of the ice-full state sensing lever 350 of the ice-full state sensing unit F.

The ice-full state sensing lever 350 includes a sensing lever body 352 which has the shape of a bar and is rotated about a point, and an engagement portion 355 which projects from one end of the sensing lever body 352 and contacts the ice-full state sensing contour 313.

An ice-full state indicating groove 313*b* is defined on a circumferential portion of the ice-full state sensing contour 313. In the case where the engagement portion 355 is engaged into the ice-full state indicating groove 313*b*, the ice-full state sensing lever 350 is rotated by a predefined angle, causing the ice-full state sensing magnet 351 not to face the ice-full state sensing sensor 353.

That is to say, in the case where the ice-full state sensing magnet 351 does not face the ice-full state sensing sensor 353, a high signal is generated to indicate the ice-full state. In the case where the ice-full state sensing magnet 351 faces the ice-full state sensing sensor 353, a low signal is generated to indicate not the ice-full state.

As shown in FIG. 8, the ice-full state indicating groove 313*b* is defined to be indented on the circumferential portion of the ice-full state sensing contour 313.

In the case where the engagement portion 355 of the ice-full state sensing lever 350 is engaged into the ice-full state indicating groove 313*b*, since the ice-full state sensing lever 350 is pulled by an elastic element S, the ice-full state sensing magnet 351 is rotated in the downward direction on the drawing, as a result of which the ice-full state sensing magnet 351 and the ice-full state sensing sensor 353 do not face each other and thus the ice-full state signal may be generated.

The ice-full state indicating groove 313*b* may be defined at a position that corresponds to a time required for the ice-detecting arm 50 to contact ice cubes when the ice-full state generally occurs.

Descriptions will be made below with reference back to FIG. 10(*b*).

In other words, as shown in the drawing, while the ejector E having been maintained in the standby state at the origin of −60° is rotated in the reverse direction (moved in the leftward direction on the drawing) by the rotation of the cam gear 310, if the ice-full state signal is generated at the point of −127°, the ejector E is then rotated in the normal direction (moved in the rightward direction on the drawing) and is stopped at the position of −60° as the origin.

To this end, by defining the ice-full state indicating groove 313*b* on a circumferential portion of the ice-full state sensing contour 313 which corresponds to the position of −127°, the engagement portion 355 is engaged into the ice-full state indicating groove 313*b*, and the ice-full state sensing magnet 351 is rotated in the downward direction on the drawing, as a result of which the ice-full state sensing magnet 351 and the ice-full state sensing sensor 353 do not face each other and thus the ice-full state signal as the high signal is generated.

If the ice-full state signal is generated, the cam gear 310 and the ejector E are rotated in the normal direction, and return to the original position, that is, the position of −60° as the origin.

If the engagement portion 355 is disengaged from the ice-full state indicating groove 313*b*, the engagement portion 355 is pushed upward, the ice-full state sensing sensor 353 and the ice-full state sensing magnet 351 face each other, and thus the low signal as not the ice-full state signal is generated. Thereafter, if the engagement portion 355 is engaged into an origin indicating groove 313*a* which is defined as will be described below, the ice-full state sensing sensor 353 and the ice-full state sensing magnet 351 do not face each other and thus the high signal as the ice-full state signal is generated.

In this regard, since the circumferential length of the origin indicating groove 313*a* is longer than the circumferential length of the ice-full state indicating groove 313*b*, the ice-full state signal as the high signal which is generated by the origin indicating groove 313*a* is generated longer than the ice-full state signal as the high signal which is generated by the ice-full state indicating groove 313*b*.

As the control unit (not shown) recognizes this difference, it is determined that the ice-full state has not actually occurred but return is made to the origin as the original position.

Namely, when making descriptions with reference to, for example, FIG. 10(*b*), since the ice-full state signal by the ice-full state indicating groove 313*b* is generated at the position of −127°, the control unit recognizes the ice-full state signal by the ice-full state indicating groove 313*b*, as the actual ice-full state, and the cam gear 310 and the ejector E are then rotated in the normal direction (moved in the rightward direction on the drawing) and return to the original position.

While the cam gear 310 and the ejector E return to the original position, the ice-full state signal by the origin indicating groove 313*a* is generated for the interval of 17° from −77° to −60° as the origin. Therefore, a difference exists between the ice-full state signal generated by the origin indicating groove 313*a* and the ice-full state signal generated by the ice-full state indicating groove 313*b*. As the control unit recognizes the difference, it is determined that the ice-full state has not actually occurred but return is made to the origin as the original position.

Therefore, according to the embodiment of the present invention, because the ejector E is not introduced into the icemaker and is rotated outward when sensing the ice-full state, the ejector E is prevented from being interfered with by the ice cubes present in the icemaker, as described above, whereby it is possible to eliminate the likelihood of the ice-full state signal to be erroneously generated.

As shown in FIG. 7, the ice-detecting lever 330 includes an ice-detecting lever body 332 which has a plate shape and is disposed to be rotated about a point, and a groove 338 which is defined to be indented on a lower side of the ice-detecting lever body 332 and is brought into contact with an engagement bar 314 interlocked with the cam gear 310.

The groove 338 is defined such that the radius between one portion of the groove 338 and the center of the cam gear 310 is larger than the length of the engagement bar 314 and the radius between the other portion of the groove 338 and the center of the cam gear 310 is smaller than the length of the engagement bar 314.

By such a construction, in the case where the cam gear 310 is rotated within a preset angle, the engagement bar 314 does not contact the groove 338, and, in the case where the cam gear 310 is rotated beyond the preset angle, the engagement bar 314 contacts the groove 338 and revolves the ice-detecting lever body 332 in the upward direction.

That is to say, in the case of the illustration of FIG. 7, the groove 338 is defined such that the left portion of the groove 338 on the drawing is relatively distant from the center of the cam gear 310 and the upper and right portions of the groove 338 on the drawing are relatively close to the center of the cam gear 310.

Accordingly, in the case where the engagement bar 314 is placed on the left portion of the groove 338 on the drawing by the rotation of the cam gear 310, the engagement bar 314 does not contact the groove 338, and thus, the ice-detecting lever 330 is not moved even though the cam gear 310 is rotated.

However, in the case where the cam gear 310 is continuously rotated, the engagement bar 314 is placed on the upper portion of the groove 338 on the drawing, and, from this time, the engagement bar 314 contacts the groove 338.

Hence, as the engagement bar 314 contacts the groove 338, the ice-detecting lever 330 revolves in the upward direction about the left end portion thereof on the drawing.

A stopper 352*a* is projectedly formed on one end of the ice-full state sensing lever 350. When the ice-detecting lever body 332 is rotated in the upward direction, the stopper 352*a* is engaged with the ice-detecting lever body 332.

By this construction, operations in the case of not the ice-full state are performed.

In other words, as described above, when the cam gear 310 is rotated, the engagement portion 355 is engaged into the ice-full state indicating groove 313*b* in the case of the actual ice-full state, but, in the case of not the actual ice-full state, the engagement bar 314 contacts the groove 338, the ice-detecting lever 330 is rotated in the upward direction and the stopper 352*a* of the ice-full state sensing lever 350 is engaged and supported by the ice-detecting lever body 332. Thus, the groove 338 is defined such that, in the case of not the actual ice-full state, the engagement portion 355 is not engaged into the ice-full state indicating groove 313*b* even though the engagement portion 355 is placed at a position to be engaged into the ice-full state indicating groove 313*b*.

Due to this fact, since the ice-full state sensing magnet 351 is kept in the state in which it faces the ice-full state sensing sensor 353, the low signal is generated.

Namely, as shown in FIG. 10(*d*), if only the low signal is sensed and the high signal as the ice-full state signal is not sensed due to the above-described construction even when the ejector E having been maintained in the standby state at the origin of −60° is rotated by the predetermined angle, for example, to the position of −135°, in the reverse direction (moved in the leftward direction on the drawing) by the rotation of the cam gear 310, it is determined that ice cubes are insufficient, and the ejector E is rotated in the normal direction to make one complete rotation, ejects ice cubes and is then stopped at the position of −60° as the origin.

As described above, in the case of the embodiment of the present invention, the cam gear 310 should be rotated in both the normal direction and the reverse direction. To this end, while it is possible to use a general motor, a step motor may be used for precise control.

In the case of the ice-detecting arm 50, as described above, while the ice-detecting arm 50 is rotated, a phenomenon may occur in which the ice-detecting arm 50 is interfered with by ejected ice cubes and is not able to return to the original position.

In this case, in order to stop the operation of the icemaker when the ice-detecting arm 50 has not returned to the original position, there may be disposed the holding gear 710 which is interlocked with the cam gear 310 at one portion thereof and is interlocked with the ice-detecting arm 50 at an opposite portion thereof, and an ice-detecting arm sensing unit T which is disposed on one portion of the holding gear 710.

The ice-detecting arm sensing unit T may include the ice-detecting arm sensing magnet 711 which is disposed on one portion of the holding gear 710, and the ice-detecting arm sensing sensor 713 which is fixed to the side of the housing H and may face the ice-detecting arm sensing magnet 711 by the revolving of the holding gear 710.

By this construction, in the case where the ice-detecting arm 50 has not returned to the original position even though the cam gear 310 has returned to the original position, the ice-detecting arm sensing magnet 711 may be caused not to face the ice-detecting arm sensing sensor 713, such that no return of the ice-detecting arm 50 may be sensed.

That is to say, as shown in FIG. 5, while the holding gear 710 is meshed with a second intermediate gear 750, since the second intermediate gear 750 is shaped to be operated integrally with a first intermediate gear 740 which is placed over the second intermediate gear 750 and is meshed with the cam gear 310, the hold gear 710 is resultantly interlocked with the cam gear 310 at one portion thereof.

Because the ice-detecting arm 50 is secured to the holding gear 710 as disclosed in the aforementioned patent documents, as a result, the holding gear 710 is interlocked with the cam gear 310 at one portion thereof and is interlocked with the ice-detecting arm 50 at an opposite portion thereof.

Accordingly, while the ice-detecting arm 50 is rotated by being interlocked with the cam gear 310, in the case where the cam gear 310 returns to the origin as the original position, the ice-detecting arm 50 returns to the original position being the bottom of the icemaker (see FIG. 3).

In the case where the ice-detecting arm 50 returns to the original position as the holding gear 710 is rotated in an interlocked manner by the rotation of the ice-detecting arm 50, the ice-detecting arm sensing magnet 711 is caused to face the ice-detecting arm sensing sensor 713, and the low signal is generated to indicate that the ice-detecting arm 50 has returned to the original position.

However, as aforementioned above, while the ice-detecting arm 50 is rotated, a phenomenon may occur in which the ice-detecting arm 50 is interfered with by ejected ice cubes and is not able to return to the original position even though the cam gear 310 has returned to the origin.

In this case, since the holding gear 710 which is interlocked with the ice-detecting arm 50 is not rotated as well, the ice-detecting arm sensing magnet 711 is caused not to face the ice-detecting arm sensing sensor 713, and the high signal is generated to indicate that the ice-detecting arm 50 has not returned to the original position.

In other words, as shown in FIG. 10(*c*), although the high signal as the ice-full state signal is generated as described above as the cam gear 310 returns to the origin, in the case where the high signal is generated by the ice-detecting arm sensing sensor 713 and it is recognized that the ice-detecting arm 50 has not returned to the original position, the operation of the icemaker is stopped.

Meanwhile, as shown in FIGS. 7 to 9, as the origin indicating groove 313*a* is additionally defined to be indented on the circumferential portion of the ice-full state sensing contour 313 in such a manner that the circumferential length of the origin indicating groove 313*a* is longer than the circumferential length of the ice-full state indicating groove 313*b*, it is possible to control the cam gear 310 to return to the origin.

Namely, while the ejector E is maintained in the standby state at the specified position, for example, the origin of −60° as described above, if a situation occurs in which, for example, the power of a refrigerator is off and the refrigerator stops to operate, it is necessary to control the ejector E to return to the origin.

In the case where the cam gear 310 which drives the ejector E is at the specified position, that is, the origin, the ice-full state signal is generated for a time longer than the case of the ice-full state, as the ice-full state sensing lever 350 is caused not to face the ice-full state sensing sensor 353.

To this end, the origin indicating groove 313*a* is defined in such a manner that the circumferential length of the origin indicating groove 313*a* is longer than the circumferential length of the ice-full state indicating groove 313*b*.

Due to this fact, if the engagement portion 355 is engaged into the origin indicating groove 313*a*, the high signal as the ice-full state signal is generated as the ice-full state sensing magnet 351 does not face the ice-full state sensing sensor 353. In this regard, the generation time of the high signal is set to be longer than the case of the actual ice-full state such that the control unit may recognize that the actual ice-full state has not occurred but it is a process of finding the origin.

That is to say, as shown in FIG. 10(*a*), the ice-full state signal is set to have the interval of 8° from −127° to −135°, and the ice-full state signal for finding the origin is set to have the interval of 25° from −52° to −77°.

By such a method, in the case where power supply is interrupted in the state in which the ejector E is at the position of −100° and is then restarted, if the ice-full state signal is generated between −127° and −135° as the cam gear 310 and the ejector E are rotated in the reverse direction (moved in the leftward direction on the drawing), since the ice-full state signal has been generated for a time shorter than the interval of 25°, the ejector E is continuously rotated in the reverse direction by neglecting the ice-full state signal, to make one complete rotation.

Thereafter, if the ice-full state signal is generated when the ejector E reaches the position of −52° and is continuously generated to the position of −77°, the ice-full state signal is determined as the ice-full state signal for finding the specified position, that is, the origin.

In this case, the ejector E is rotated in the normal direction (moved in the rightward direction on the drawing) from the position where the generation of the ice-full state signal is ended, that is, from the position of −77°, by the preselected angle, that is, −17°, such that the ejector E is positioned at the origin.

If the ice-full state signal is not generated between −127° and −135° (the ice-full state has not occurred), the ejector E is continuously rotated in the reverse direction to make one complete rotation. Then, if the ice-full state signal is generated when the ejector E reaches the position of −52° and is continuously generated to the position of −77°, the control unit determines the ice-full state signal as the ice-full state signal for finding the specified position, that is, the origin, as described above.

In this case, the control unit rotates the cam gear 310 from the position of −77° in the normal direction (in the rightward direction on the drawing), and causes the ejector E to reach the origin of −60°.

However, such a driving method may be used only in a particular situation, that is, only when power supply or the like is interrupted, and may not be used in a normal situation. That is to say, only in the case where the control unit recognizes the situation, an initial setting operation for finding the position of the origin may be performed as described above.

As shown in FIGS. 5 and 6, a first transfer member 500 which is constructed by a plurality of gears may be additionally included to be disposed between the driving motor 100 and the cam gear 310 so as to transfer power.

The control unit which is connected to the driving motor 100, the ice-full state sensing unit F or the ice-detecting arm sensing unit T may be additionally included to determine and control the ice-full state, the return of the ice-detecting arm 50, and so on.

As shown in FIGS. 11 to 14, the apparatus for driving an icemaker of a refrigerator in accordance with the embodiment of the present invention is constructed by a driving block for driving the ice-detecting arm 50, and the housing H to which the driving block is mounted.

The driving block includes the driving motor 100 as described above, a cam gear group 300, the first transfer member 500 which is interposed between the driving motor 100 and the cam gear group 300, and a second transfer member 700 which is interposed between the cam gear group 300 and the ice-detecting arm 50.

The driving block is mounted to the housing H constructed by the case A and the cover B which covers the case A, and is secured and locked to one side of an ice-making tray.

The driving motor 100 may be realized by a step motor capable of normal rotation and reverse rotation as described above, and the driving gear 110 is mounted to the rotation shaft of the driving motor 100. A worm or a pinion may be adopted as the driving gear 110.

The cam gear group 300 is constructed by the cam gear 310 which is rotated together with the ejector E for ejecting the ice cubes made in the ice-making tray, to an ice bank, and the ice-detecting lever 330 which is interlocked with the rotation of the cam gear 310.

Also, in the cam gear group 300, the ice-full state sensing lever 350 as described above is disposed to be interlocked with the rotation of the cam gear 310. The ice-full state sensing magnet 351 is mounted to the ice-full state sensing lever 350.

The ice-full state sensing sensor 353 is mounted to the housing H or a PCB 200 which is disposed in the housing H. The ice-full state sensing sensor 353 functions to sense the origin and the ice-full state as described above.

The ejector E of the ice-making tray is coupled to the rotation center of the cam gear 310 to be integrally rotated therewith. The cam gear 310 is transferred with the rotation force of the driving gear 110 through the first transfer member 500 which forms a gear group for speed-reduction.

In other words, the first transfer member 500 is constructed by a first gear 511 which is meshed with the driving gear 110, a second gear 512 which is coupled to the same rotation shaft as the first gear 511, a third gear 513 which is meshed with the second gear 512, a fourth gear 514 which is coupled to the same rotation shaft as the third gear 513, a fifth gear 515 which is meshed with the fourth gear 514, a sixth gear 516 which is coupled to the same rotation shaft as the fifth gear 515, a seventh gear 517 which is meshed with the sixth gear 516, and an eighth gear 518 which is coupled to the same rotation shaft as the seventh gear 517. The eighth gear 518 is meshed with the cam gear 310.

A first cam surface 311 and a second cam surface (not shown) are formed on the upper and lower surfaces of the cam gear 310.

A cam follower 331 of the ice-detecting lever 330 is brought into contact with the first cam surface 311, and the cam follower (not shown) of the ice-full state sensing lever 350 is brought into contact with the second cam surface.

The cam follower 331 of the ice-detecting lever 330 elastically contacts the first cam surface 311 by a second torsion spring 400 which will be described later, and the cam follower of the ice-full state sensing lever 350 elastically contacts the second cam surface by a tension spring (not shown). One end of the tension spring is supported by the case A, and the other end of the tension spring is supported by the ice-full state sensing lever 350.

Accordingly, the ice-detecting lever 330 and the ice-full state sensing lever 350 are rotated together according to the normal rotation or the reverse rotation of the cam gear 310.

One end portion of the ice-detecting lever 330 is installed on a support shaft 333 which is formed on the case A, and teeth 335 are formed in the shape of a sector gear on the other end portion of the ice-detecting lever 330.

The cam follower 331 is formed on the inner surface of the ice-detecting lever 330 between the one end portion and the lower end portion of the ice-detecting lever 330, and a first support pin 411*a* for supporting a first arm 411 of the second torsion spring 400 is formed on the outer surface of the other end portion of the ice-detecting lever 330.

As shown in FIGS. 11, 12 and 20, the second torsion spring 400 is constructed by a cylindrical coil part 410, and the first arm 411 and a second arm 413 which are respectively formed on one and opposite sides of the cylindrical coil part 410.

The cylindrical coil part 410 is fitted around and supported by a guide pin 415 of the cover B, the first arm 411 is supported by the first support pin 411*a*, and the second arm 413 is supported by a second support pin 413*a* of the cover B.

Namely, the position of the cylindrical coil part 410 or the guide pin 415 is set at a location that faces at least the teeth 335 of the ice-detecting lever 330 as the revolving end of the ice-detecting lever 330.

Due to such positioning, since the moment applied to the ice-detecting lever 330 by an elastic reaction force may act substantially constantly as a minimum amount, it is possible to prevent adverse influences from being exerted on the durability or the precision of rotation of the components interlocked with the ice-detecting lever 330.

That is to say, the arm length r1 of the reaction force f1 is the distance between the support shaft 333 of the ice-detecting lever 330 and the first support pin 411*a* as a reaction point.

If the ice-detecting lever 330 is rotated downward from the state of the initial moment M1, the first support pin 411*a* rotates the first arm 411 downward by the same angle.

This state corresponds to the reaction force f2, and this elastic reaction force f2 is markedly larger than the reaction force f1. However, as may be seen from FIG. 20, the arm length r2 of the reaction force f2 is the distance between the support shaft 333 and the first support pin 411*a* as a reaction point, and is markedly shorter than the arm length r1.

Therefore, the value of the initial minimum moment M1 becomes approximately equal to the displaced moment M2, such that a minimum amount of torque may be substantially constantly applied.

As shown in FIGS. 12 and 14, an opening BP is defined through the cover B such that the first support pin 411*a* is exposed to an outside. Therefore, a cover plate is installed on the case A to cover the opening BP defined through the cover B.

The second transfer member 700 is constructed by the holding gear 710 which holds the ice-detecting arm 50, and an intermediate gear 730 which is interposed between the cam gear group 300 and the holding gear 710.

The ice-detecting arm sensing magnet 711 as described above is mounted to the holding gear 710, and the ice-detecting arm sensing sensor 713 for sensing the ice-detecting arm sensing magnet 711 is mounted to the PCB 200.

A rotation shaft 715 of the holding gear 710 may be used as a holding shaft 715 on which the ice-detecting arm 50 is held.

Teeth 717 are formed on only a partial circumferential portion of the holding gear 710.

As shown in FIGS. 15 to 18, the intermediate gear 730 includes the first intermediate gear 740 which is formed with teeth 745 meshed with the teeth 335 of the ice-detecting lever 330, the second intermediate gear 750 which is formed with teeth 755 meshed with the teeth 717 of the holding gear 710, and a first torsion spring 770 which is mounted to the first intermediate gear 740 and the second intermediate gear 750.

The first torsion spring 770 is constructed by a cylindrical coil part 771, and a first arm 773 and a second arm 775 which extend from one and opposite sides of the cylindrical coil part 771, similarly to the second torsion spring 400 described above. However, the function of the first torsion spring 770 is quite different from the function of the second torsion spring 400.

In other words, in the case where a load is applied to the ice-detecting arm 50, since the second intermediate gear 750 meshed with the holding gear 710 is also applied with a load, the first torsion spring 770 functions to absorb a rotation force to be applied from the second intermediate gear 750 to the first intermediate gear 740, through the elastic deformation thereof.

A support shaft 751 is projectedly formed at the rotation center of the second intermediate gear 750. The support shaft 751 also serves as a guide pin around which the cylindrical coil part 771 of the first torsion spring 770 is installed by being fitted.

A groove 752 is defined around the support shaft 751. Second engagement projections 757 are formed in the groove 752. Two second engagement projections 757 may be projectedly formed in such a way as to be spaced apart by 180° from each other around the support shaft 751.

A second engagement groove 753, in which the second arm 775 of the first torsion spring 770 is engaged, is radially defined through a portion of the second intermediate gear 750.

A displacement section 759, through which the second arm 775 may be elastically deformed, is partially defined on the circumference of the second intermediate gear 750.

A through hole 741, through which the support shaft 751 passes by being inserted, is defined at the rotation center of the first intermediate gear 740.

First engagement projections 747, which interact with the second engagement projections 757, are formed on the lower surface of the first intermediate gear 740. As shown in FIG. 17, two first engagement projections 747 may be projectedly formed in such a way as to be spaced apart by 180° from each other around the through hole 741.

Thus, the first engagement projections 747 of the first intermediate gear 740 push the second engagement projections 757 of the second intermediate gear 750 to be rotated together.

A first engagement groove 743, in which the first arm 773 of the first torsion spring 770 is engaged, is radially defined through a portion of the first intermediate gear 740.

Therefore, in the case where a load is applied to the holding gear 710, since the second intermediate gear 750 is also applied with a load, the first arm 773 is elastically deformed through the displacement section 759 and prevents the motor 100 from being overloaded.

In particular, the rotation angle ratio of the second intermediate gear 750 and the holding gear 710 may be set to approximately 1:2.

As the first torsion spring 770 is mounted where a rotation angle ratio is small in this way, only a minimum amount of torque may be transferred to other components such as the ice-detecting lever 330.

By forming only the construction of the holding shaft 715 for holding the ice-detecting arm 50 on the holding gear 710, since the holding shaft 715 may also serve as a rotation shaft, it is possible to omit a complicated construction as in the conventional art, in which a holder is relatively rotated with respect to a third gear.

What is claimed is:

1. A method for driving an icemaker of a refrigerator, the icemaker including a driving motor, a cam gear which is interlocked with and is rotated by the driving motor and which is positioned in an original position, an ice-detecting lever which is interlocked with the cam gear and revolves about a point, an ice-full state sensing unit which is interlocked with the ice-detecting lever and determines an ice-full state and which generates an ice-full state signal, an ice-detecting arm which is located at a bottom of the icemaker when the cam gear is positioned in the original position and which is interlocked with the cam gear and contacts ice cubes, an ejector which is interlocked with the cam gear and ejects ice cubes, and a housing which houses the driving motor, the cam gear, the ice-detecting lever and the ice-full state sensing unit, the method comprising:

rotating the cam gear, the ejector and the ice-detecting arm from the original position by a predetermined angle in a reverse direction, which is a direction opposite to an ice-ejecting direction, by the driving motor to determine the ice-full state;

rotating the cam gear in a normal direction, which is the ice-ejecting direction, by the driving motor such that the ice-detecting arm is located at the bottom of the icemaker and the cam gear returns to the original position when the ice-full state signal is generated while the cam gear, the ejector and the ice-detecting arm are rotated in the reverse direction;

rotating the cam gear in the normal direction by the driving motor such that the ejector ejects the ice cubes and the ice-detecting arm is located at the bottom of the icemaker and the cam gear returns to the original position when the ice-full state signal is not generated while the cam gear, the ejector and the ice-detecting arm are rotated by the predetermined angle in the reverse direction, and controlling the cam gear or the ejector to be maintained at a specified position, wherein the ice-full state sensing unit includes an ice-full state sensing lever which is interlocked with the cam gear and revolves in upward and downward directions, an ice-full state sensing magnet which is mounted to the ice-full state sensing lever, and an ice-full state sensing sensor which is fixed to a side of the housing and is caused to face the ice-full state sensing magnet by revolving of the ice-full state sensing lever, wherein the ice-full state is determined in such a manner that the ice-full state signal is generated in the case of the ice-full state as the ice-full state sensing lever is caused not to face the ice-full state sensing sensor and the ice-full state signal is not generated in the case of not the ice-full state as the ice-full state sensing lever is caused to face the ice-full state sensing sensor, and wherein controlling the cam gear or the ejector includes:

causing the ice-full state sensing lever not to face the ice-full state sensing sensor such that the ice-full state signal is generated for a time longer than a case of the ice-full state when the cam gear is at the specified position; and rotating the cam gear oppositely by a preselected angle from an ending time of the ice-full state signal such that the cam gear or the ejector is maintained at the specified position when, while the cam gear is rotated in the reverse direction, the ice-full state signal generated by the ice-full state sensing sensor is generated for a time longer than a predetermined time.

2. The method according to claim 1, wherein the icemaker further includes a holding gear which is interlocked with the ice-detecting arm, an ice-detecting arm sensing magnet which is disposed on a side of the holding gear, and an ice-detecting arm sensing sensor which is fixed to the side of the housing and is caused to face the ice-detecting arm sensing magnet by revolving of the holding gear, and wherein the method further comprises stopping an operation of the icemaker when the ice-detecting arm sensing magnet does not face the ice-detecting arm sensing sensor even though the cam gear returns to the original position.

* * * * *